US008284146B2

(12) United States Patent
Imai et al.

(10) Patent No.: US 8,284,146 B2
(45) Date of Patent: Oct. 9, 2012

(54) DISPLAY DEVICE, ITS DRIVING CIRCUIT, AND DRIVING METHOD

(75) Inventors: Masahiro Imai, Osaka (JP); Noriyuki Nakane, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 619 days.

(21) Appl. No.: 12/312,783

(22) PCT Filed: Nov. 20, 2007

(86) PCT No.: PCT/JP2007/072450

§ 371 (c)(1),
(2), (4) Date: May 27, 2009

(87) PCT Pub. No.: WO2008/096493

PCT Pub. Date: Aug. 14, 2008

(65) Prior Publication Data

US 2010/0066923 A1 Mar. 18, 2010

(30) Foreign Application Priority Data

Feb. 9, 2007 (JP) ..... 2007-030394

(51) Int. Cl.
*G09G 3/36* (2006.01)

(52) U.S. Cl. ..... 345/98; 345/96; 345/204

(58) Field of Classification Search ..... 345/87–100, 345/208–210, 204
See application file for complete search history.

(56) References Cited

U.S. PATENT DOCUMENTS 6,876,351 B2 * 4/2005 Tokonami et al. ..... 345/94
7,042,431 B1 5/2006 Washio et al.
7,701,426 B2 * 4/2010 Yokoyama et al. ..... 345/87
2003/0052852 A1 * 3/2003 Oohira ..... 345/89
2005/0104829 A1 * 5/2005 Aoki ..... 345/89
2005/0116944 A1 6/2005 Aoki
2007/0152942 A1 * 7/2007 Yamagishi ..... 345/96

FOREIGN PATENT DOCUMENTS

| | | |
|---|---|---|
| JP | 11-296148 | 10/1999 |
| JP | 2001-202066 | 7/2001 |
| JP | 2002-40993 | 2/2002 |
| JP | 2003-223152 | 8/2003 |
| JP | 2003-330425 | 11/2003 |
| JP | 2005-62535 | 3/2005 |

OTHER PUBLICATIONS

Supplementary European Search Report dated Jan. 20, 2011.

* cited by examiner

*Primary Examiner* — Amare Mengistu
*Assistant Examiner* — Hong Zhou
(74) *Attorney, Agent, or Firm* — Harness, Dickey & Pierce, P.L.C.

(57) ABSTRACT

The present invention relates to a display device and, more particularly, to an active matrix-type display device employing a line inversion drive scheme as a drive scheme.
In a liquid crystal display device employing the line inversion drive scheme as a drive scheme, a predetermined video signals are applied to video signal lines in a predetermined period after start of a vertical blanking period. When a vertical scanning period starts in an even-numbered frame, a source potential (VS) decreases by ½ of amplitude in an effective video period. After the decreased source potential (VS) is maintained only for one horizontal scanning period, source bus lines are set to a high-impedance state. When a vertical scanning period starts in an odd-numbered frame, the source potential (VS) rises by ½ of amplitude in the effective video period. After the risen source potential VS is maintained only in one horizontal scanning period, the source bus lines are set to a high-impedance state.

26 Claims, 18 Drawing Sheets

HORIZONTAL SCANNING PERIOD
WRITING TO FINAL LINE
VERTICAL BLANKING PERIOD
HIGH IMPEDANCE
Fig.1A VS
Fig.1B GND
WRITING
TARGET POTENTIAL
ΔVa
Fig.1C Veven
ΔV
Ve
Fig.1D VCOM
Fig.1E VCOM
Vo
ΔVa
ΔV
Fig.1F Vodd
ΔVa
WRITING
TARGET POTENTIAL
t1 t2 t3 t4 t5 t6 t7

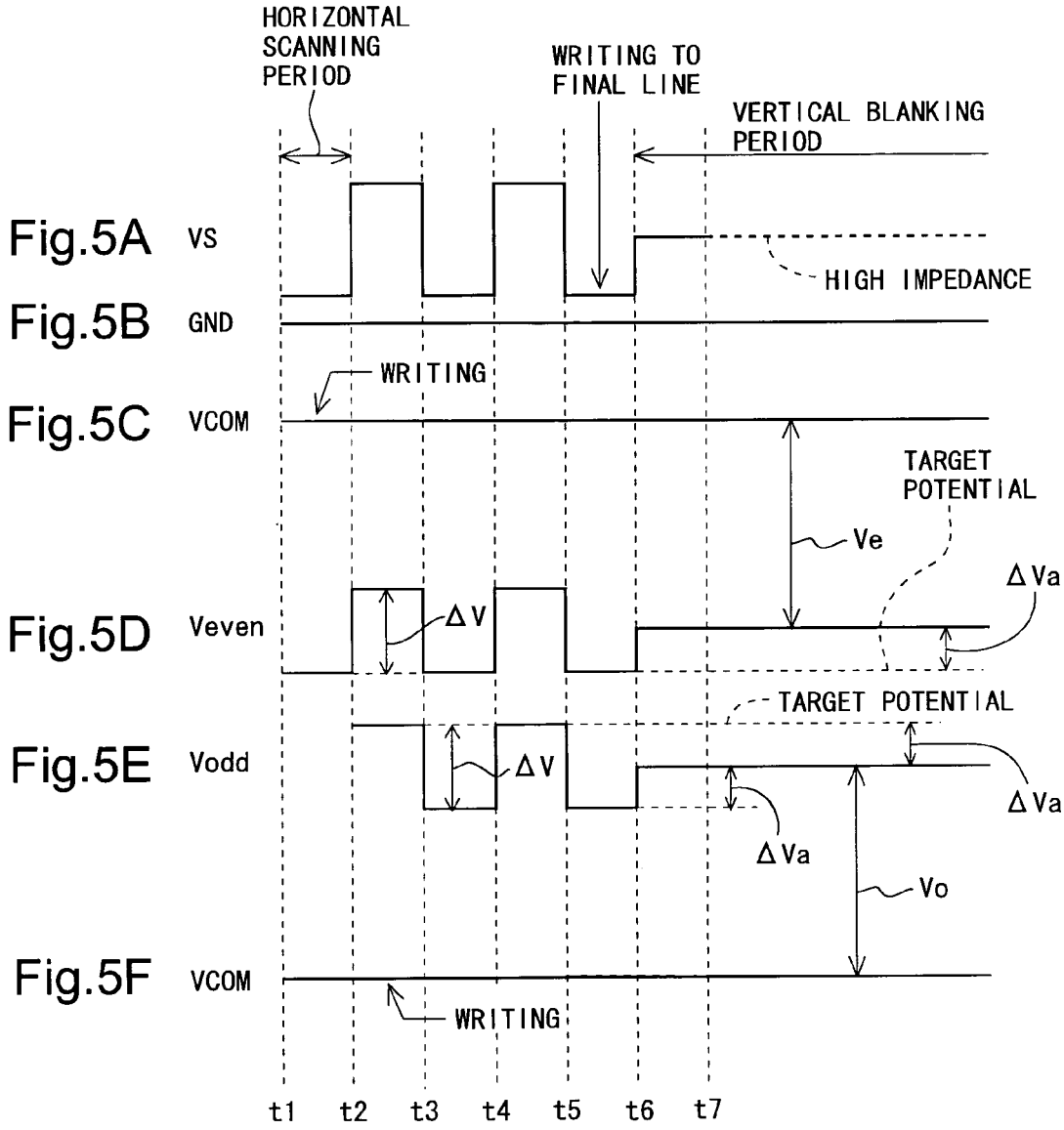
HORIZONTAL SCANNING PERIOD
WRITING TO FINAL LINE
VERTICAL BLANKING PERIOD
Fig.5A VS
HIGH IMPEDANCE
Fig.5B GND
WRITING
Fig.5C VCOM
TARGET POTENTIAL
Ve
ΔVa
Fig.5D Veven
ΔV
TARGET POTENTIAL
Fig.5E Vodd
ΔV
ΔVa
ΔVa
Vo
Fig.5F VCOM
WRITING
t1 t2 t3 t4 t5 t6 t7

HORIZONTAL SCANNING PERIOD
WRITING TO FINAL LINE
VERTICAL BLANKING PERIOD
9V
HIGH IMPEDANCE

VS
1V
5V

GND
WRITING
9V
TARGET POTENTIAL
20mV

Veven
40mV
Ve
5V

VCOM

VCOM
5V
Vo
40mV

Vodd
1V
20mV
WRITING
TARGET POTENTIAL
t1
t2
t3
t4
t5
t6
t7

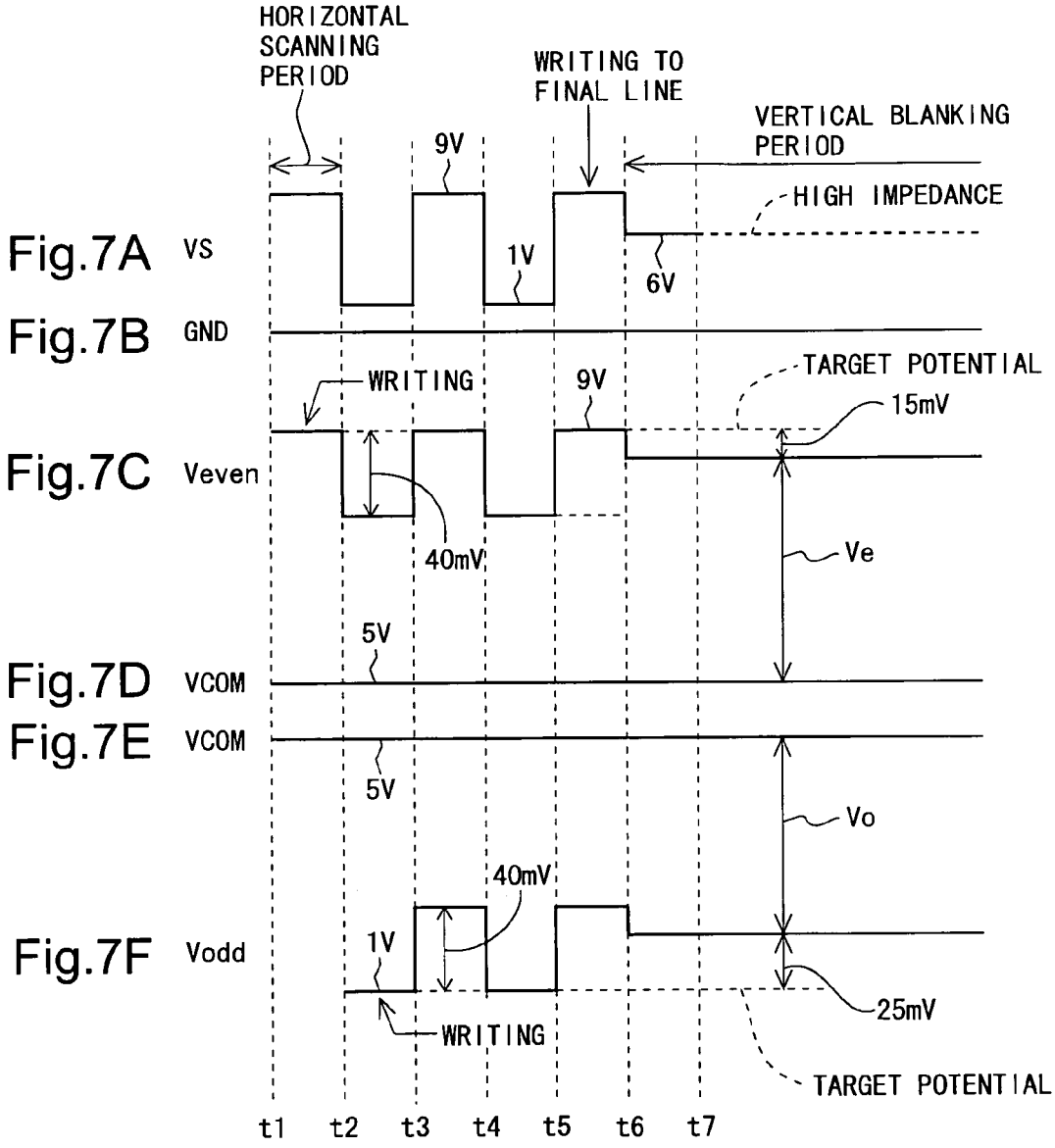
HORIZONTAL SCANNING PERIOD
WRITING TO FINAL LINE
VERTICAL BLANKING PERIOD
9V
HIGH IMPEDANCE
Fig.7A VS
1V
6V
Fig.7B GND
WRITING
9V
TARGET POTENTIAL
15mV
Fig.7C Veven
40mV
Ve
5V
Fig.7D VCOM
Fig.7E VCOM
5V
Vo
40mV
Fig.7F Vodd
1V
25mV
WRITING
TARGET POTENTIAL
t1 t2 t3 t4 t5 t6 t7

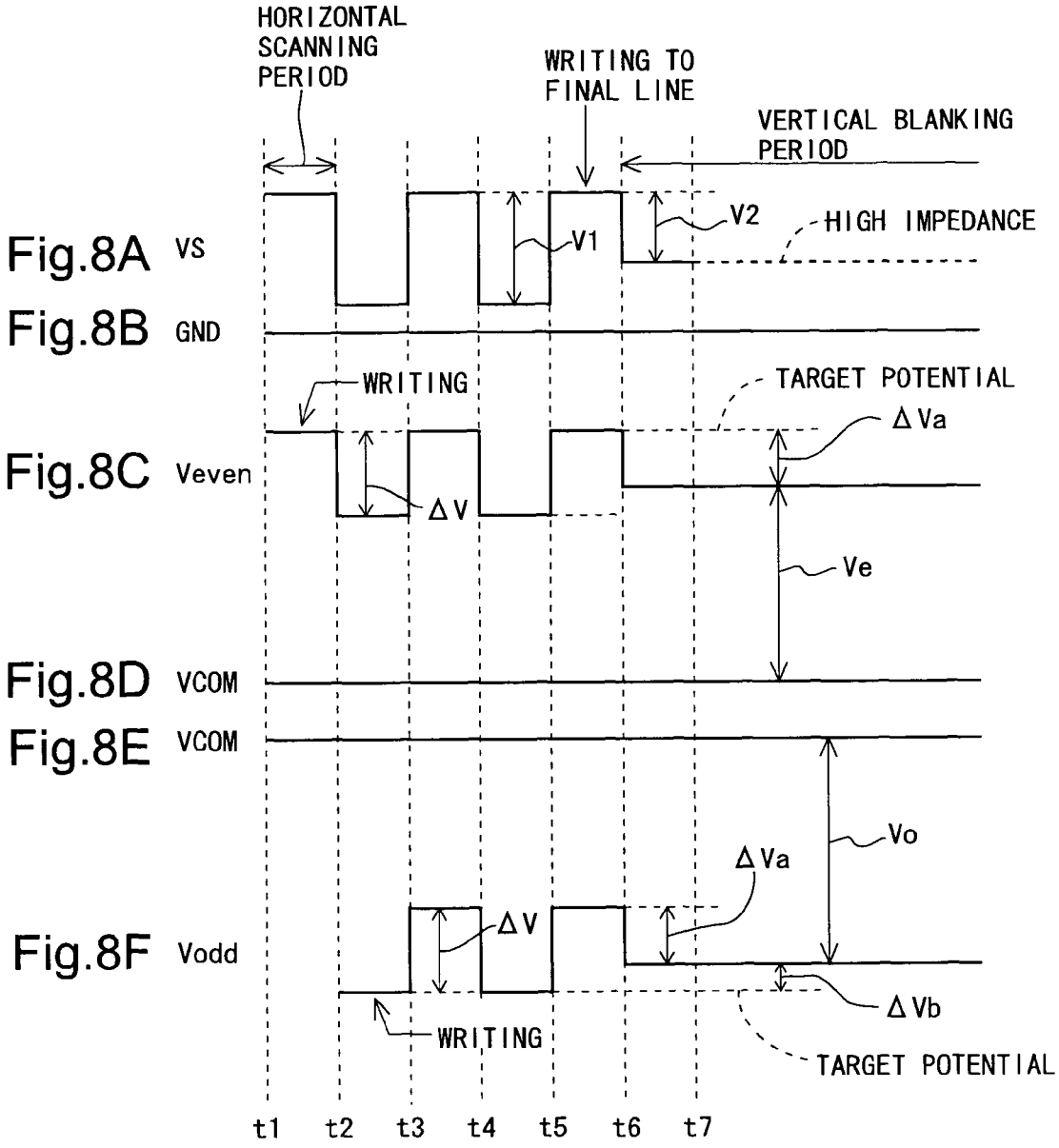
HORIZONTAL SCANNING PERIOD
WRITING TO FINAL LINE
VERTICAL BLANKING PERIOD
Fig.8A VS
V1
V2
HIGH IMPEDANCE
Fig.8B GND
WRITING
TARGET POTENTIAL
ΔVa
Fig.8C Veven
ΔV
Ve
Fig.8D VCOM
Fig.8E VCOM
Vo
ΔVa
Fig.8F Vodd
ΔV
ΔVb
WRITING
TARGET POTENTIAL
t1
t2
t3
t4
t5
t6
t7

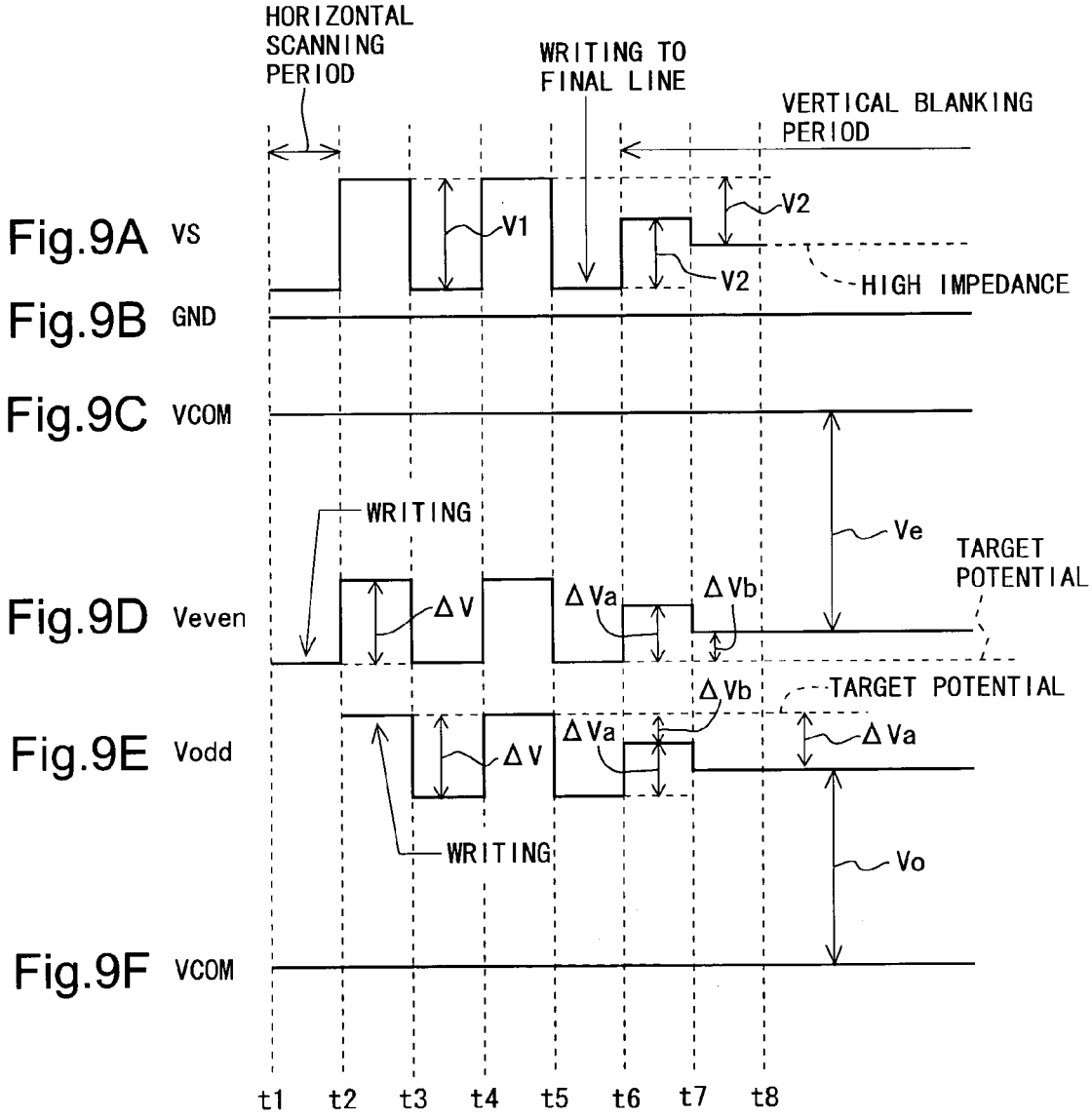
HORIZONTAL SCANNING PERIOD
WRITING TO FINAL LINE
VERTICAL BLANKING PERIOD
Fig.9A VS
V1
V2
V2
HIGH IMPEDANCE
Fig.9B GND
Fig.9C VCOM
Ve
WRITING
TARGET POTENTIAL
Fig.9D Veven
ΔV
ΔVa
ΔVb
ΔVb
TARGET POTENTIAL
Fig.9E Vodd
ΔV
ΔVa
ΔVa
WRITING
Vo
Fig.9F VCOM
t1
t2
t3
t4
t5
t6
t7
t8

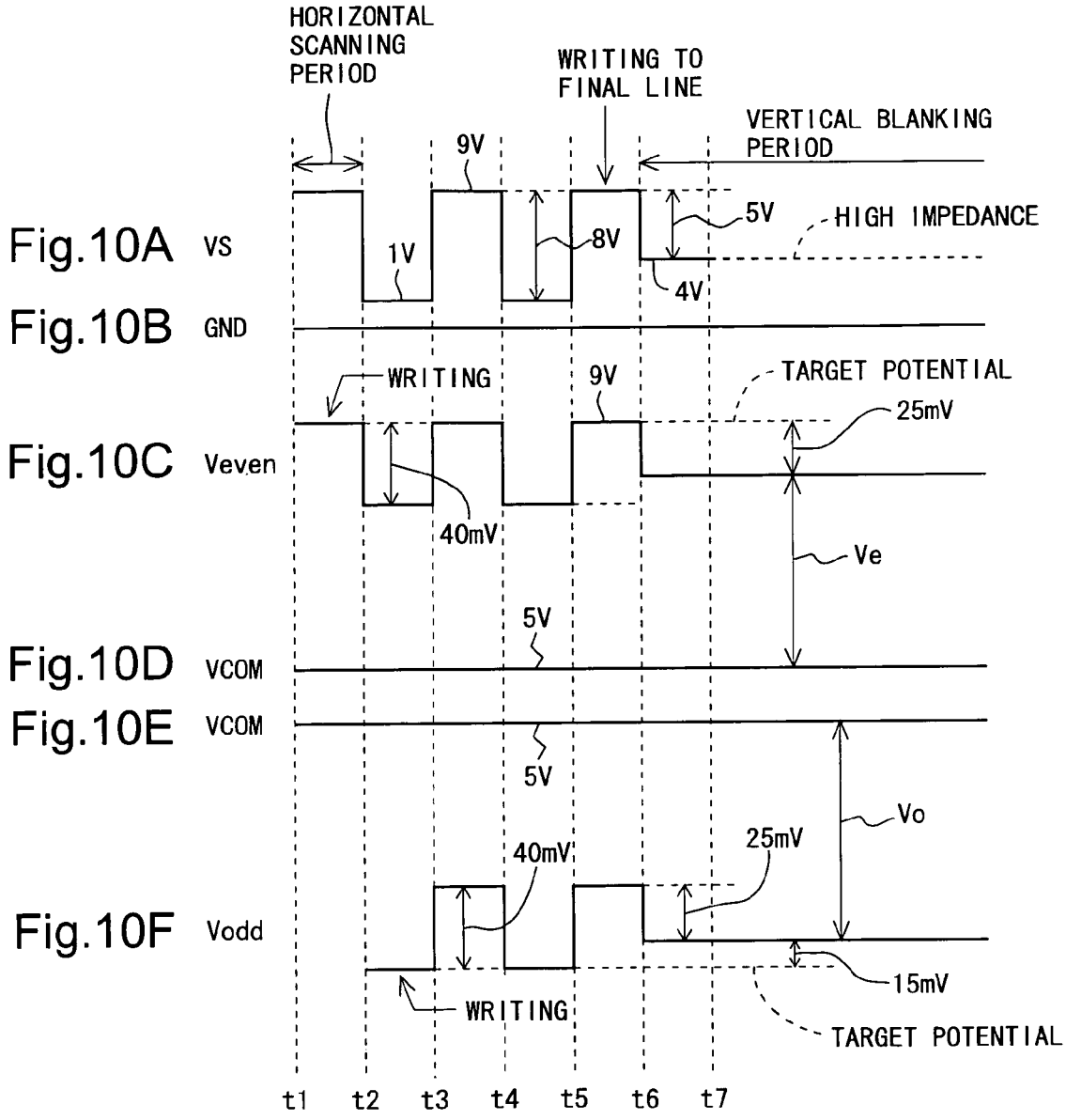
HORIZONTAL SCANNING PERIOD
WRITING TO FINAL LINE
VERTICAL BLANKING PERIOD
Fig.10A VS
Fig.10B GND
Fig.10C Veven
Fig.10D VCOM
Fig.10E VCOM
Fig.10F Vodd
9V
1V
8V
5V
4V
HIGH IMPEDANCE
WRITING
TARGET POTENTIAL
25mV
40mV
Ve
5V
Vo
40mV
25mV
15mV
WRITING
TARGET POTENTIAL
t1
t2
t3
t4
t5
t6
t7

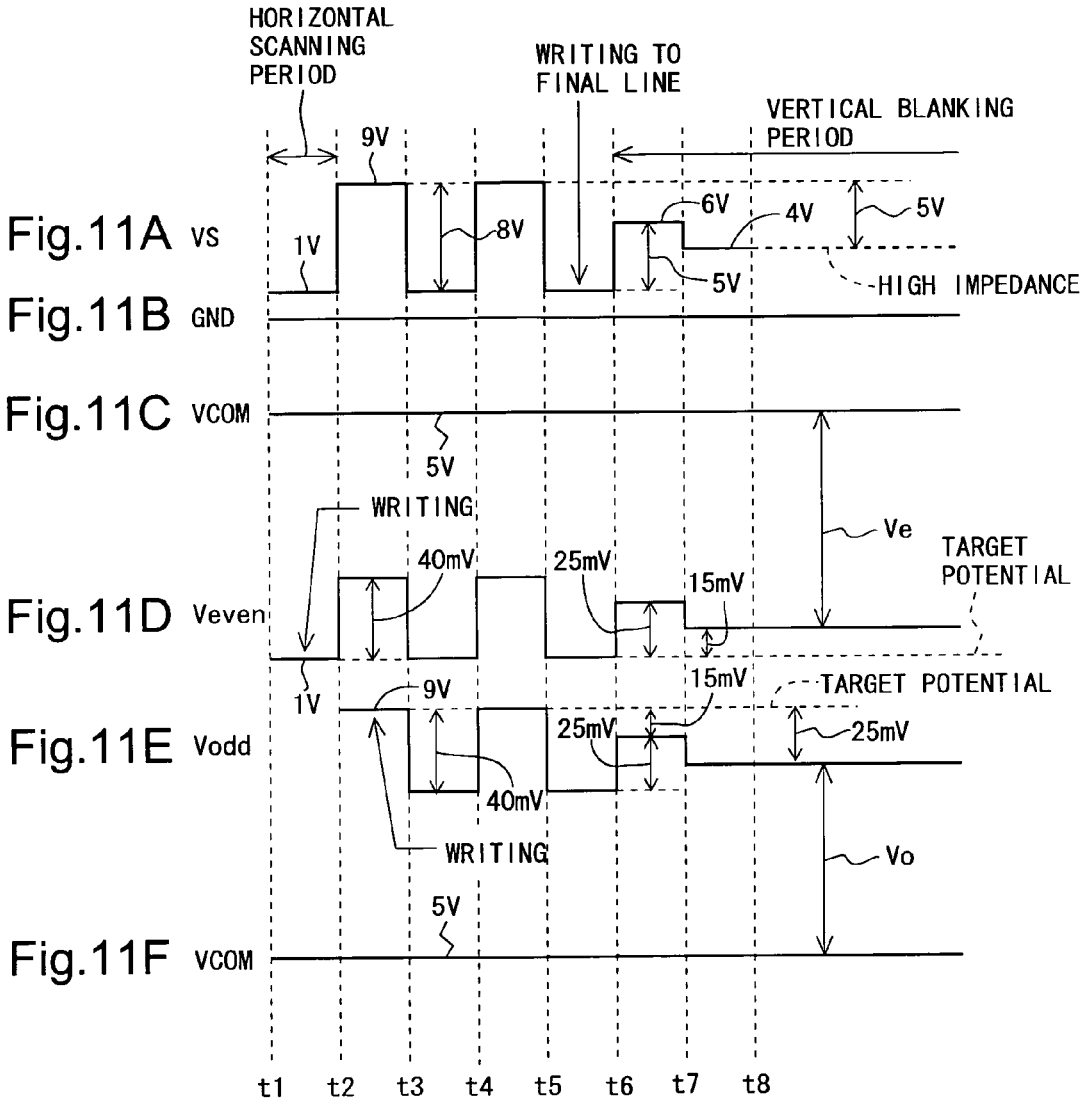
HORIZONTAL SCANNING PERIOD
WRITING TO FINAL LINE
VERTICAL BLANKING PERIOD
Fig.11A VS
Fig.11B GND
Fig.11C VCOM
Fig.11D Veven
Fig.11E Vodd
Fig.11F VCOM
9V
1V
8V
6V
4V
5V
5V
HIGH IMPEDANCE
5V
WRITING
40mV
25mV
15mV
Ve
TARGET POTENTIAL
1V
9V
15mV
TARGET POTENTIAL
25mV
25mV
40mV
WRITING
Vo
5V
t1
t2
t3
t4
t5
t6
t7
t8

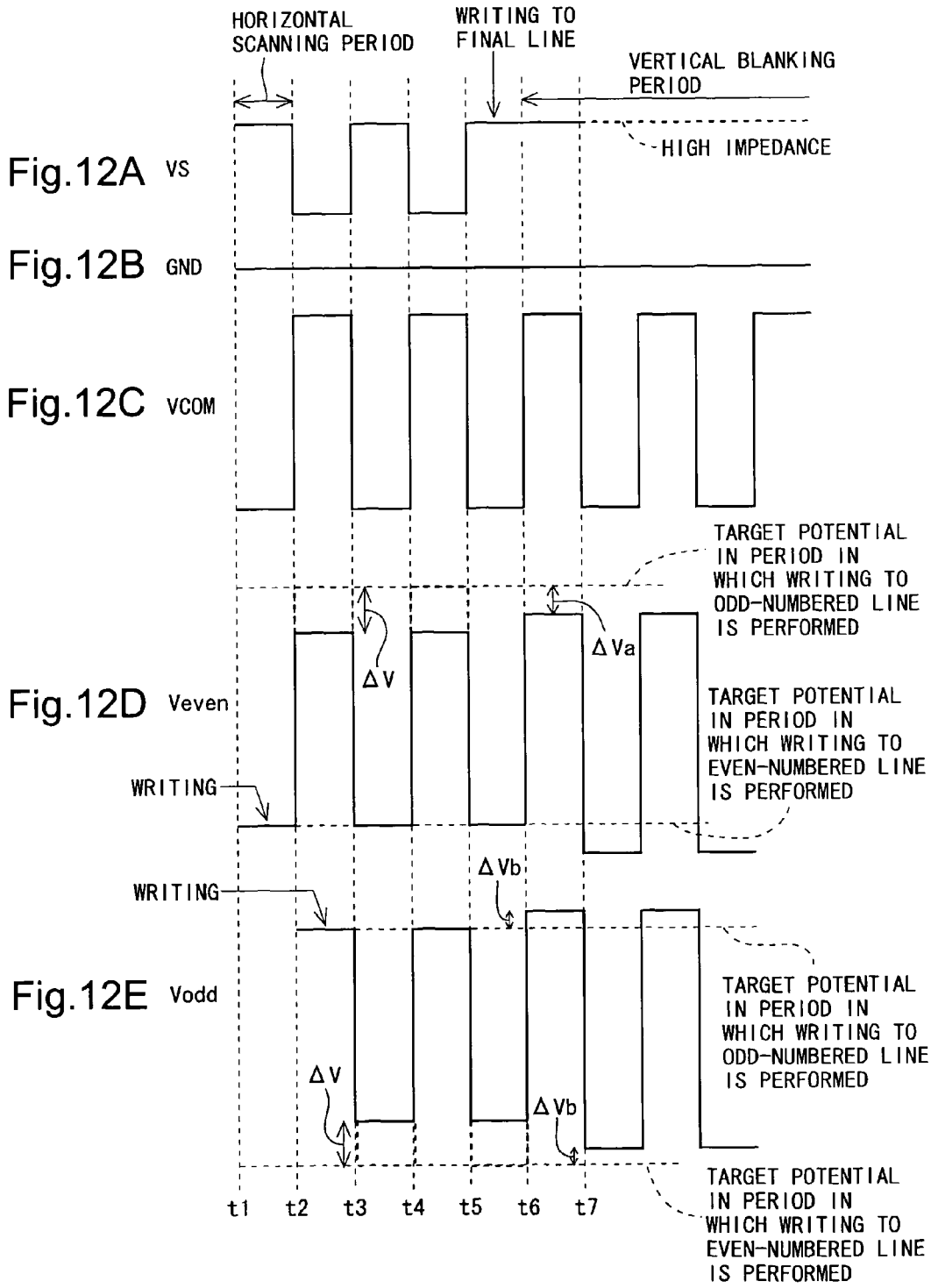
HORIZONTAL SCANNING PERIOD
WRITING TO FINAL LINE
VERTICAL BLANKING PERIOD
HIGH IMPEDANCE
Fig.12A VS
Fig.12B GND
Fig.12C VCOM
TARGET POTENTIAL IN PERIOD IN WHICH WRITING TO ODD-NUMBERED LINE IS PERFORMED
ΔVa
ΔV
Fig.12D Veven
TARGET POTENTIAL IN PERIOD IN WHICH WRITING TO EVEN-NUMBERED LINE IS PERFORMED
WRITING
ΔVb
WRITING
Fig.12E Vodd
TARGET POTENTIAL IN PERIOD IN WHICH WRITING TO ODD-NUMBERED LINE IS PERFORMED
ΔV
ΔVb
t1 t2 t3 t4 t5 t6 t7
TARGET POTENTIAL IN PERIOD IN WHICH WRITING TO EVEN-NUMBERED LINE IS PERFORMED

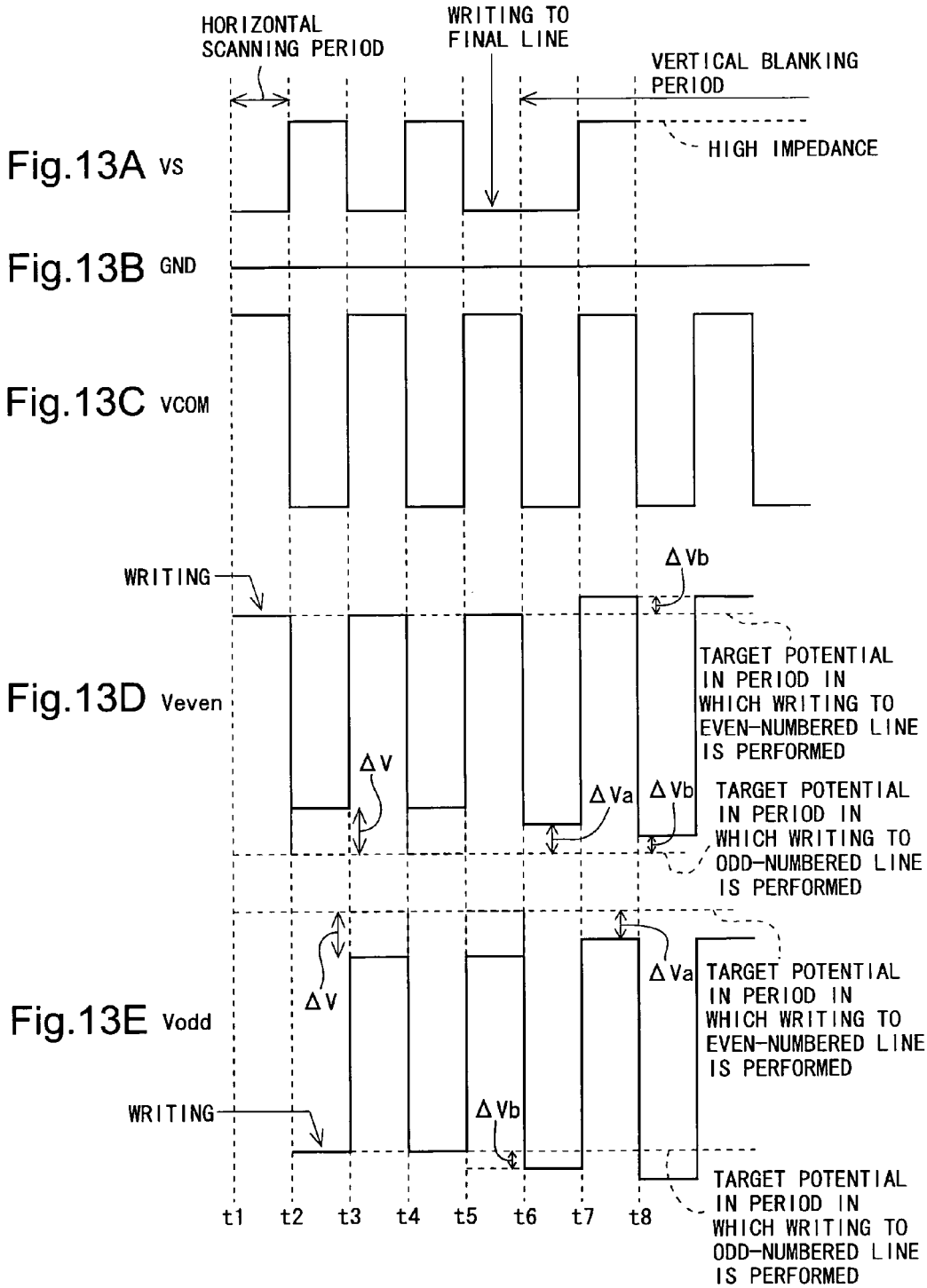
HORIZONTAL SCANNING PERIOD
WRITING TO FINAL LINE
VERTICAL BLANKING PERIOD
HIGH IMPEDANCE
Fig.13A VS
Fig.13B GND
Fig.13C VCOM
WRITING
ΔVb
TARGET POTENTIAL IN PERIOD IN WHICH WRITING TO EVEN-NUMBERED LINE IS PERFORMED
Fig.13D Veven
ΔV
ΔVa
ΔVb
TARGET POTENTIAL IN PERIOD IN WHICH WRITING TO ODD-NUMBERED LINE IS PERFORMED
ΔV
ΔVa
TARGET POTENTIAL IN PERIOD IN WHICH WRITING TO EVEN-NUMBERED LINE IS PERFORMED
Fig.13E Vodd
WRITING
ΔVb
TARGET POTENTIAL IN PERIOD IN WHICH WRITING TO ODD-NUMBERED LINE IS PERFORMED
t1
t2
t3
t4
t5
t6
t7
t8

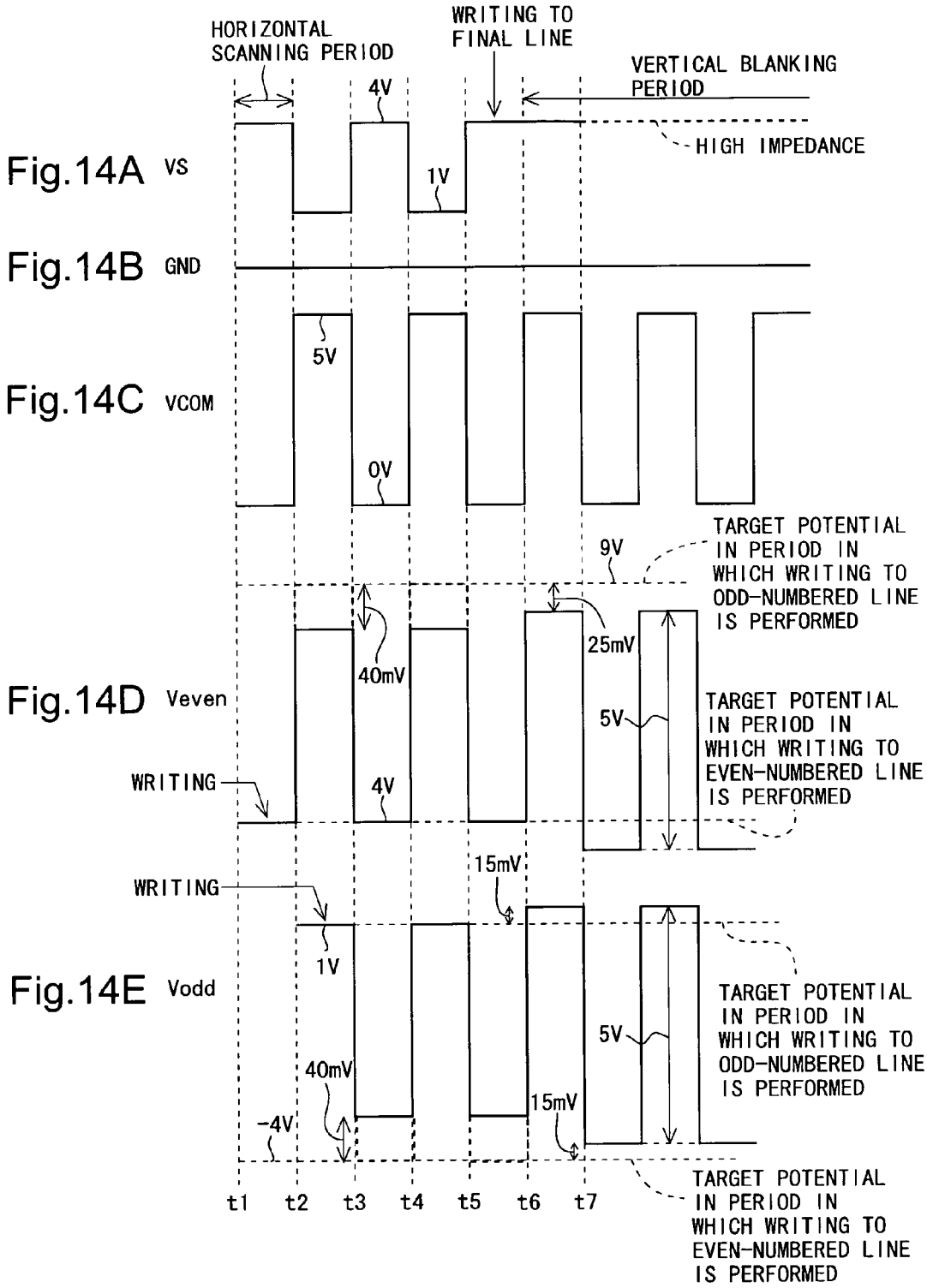
HORIZONTAL SCANNING PERIOD
WRITING TO FINAL LINE
VERTICAL BLANKING PERIOD
4V
HIGH IMPEDANCE
Fig.14A VS
1V
Fig.14B GND
5V
Fig.14C VCOM
0V
TARGET POTENTIAL IN PERIOD IN WHICH WRITING TO ODD-NUMBERED LINE IS PERFORMED
9V
25mV
40mV
Fig.14D Veven
5V
TARGET POTENTIAL IN PERIOD IN WHICH WRITING TO EVEN-NUMBERED LINE IS PERFORMED
WRITING
4V
15mV
WRITING
1V
Fig.14E Vodd
TARGET POTENTIAL IN PERIOD IN WHICH WRITING TO ODD-NUMBERED LINE IS PERFORMED
5V
40mV
15mV
-4V
t1
t2
t3
t4
t5
t6
t7
TARGET POTENTIAL IN PERIOD IN WHICH WRITING TO EVEN-NUMBERED LINE IS PERFORMED

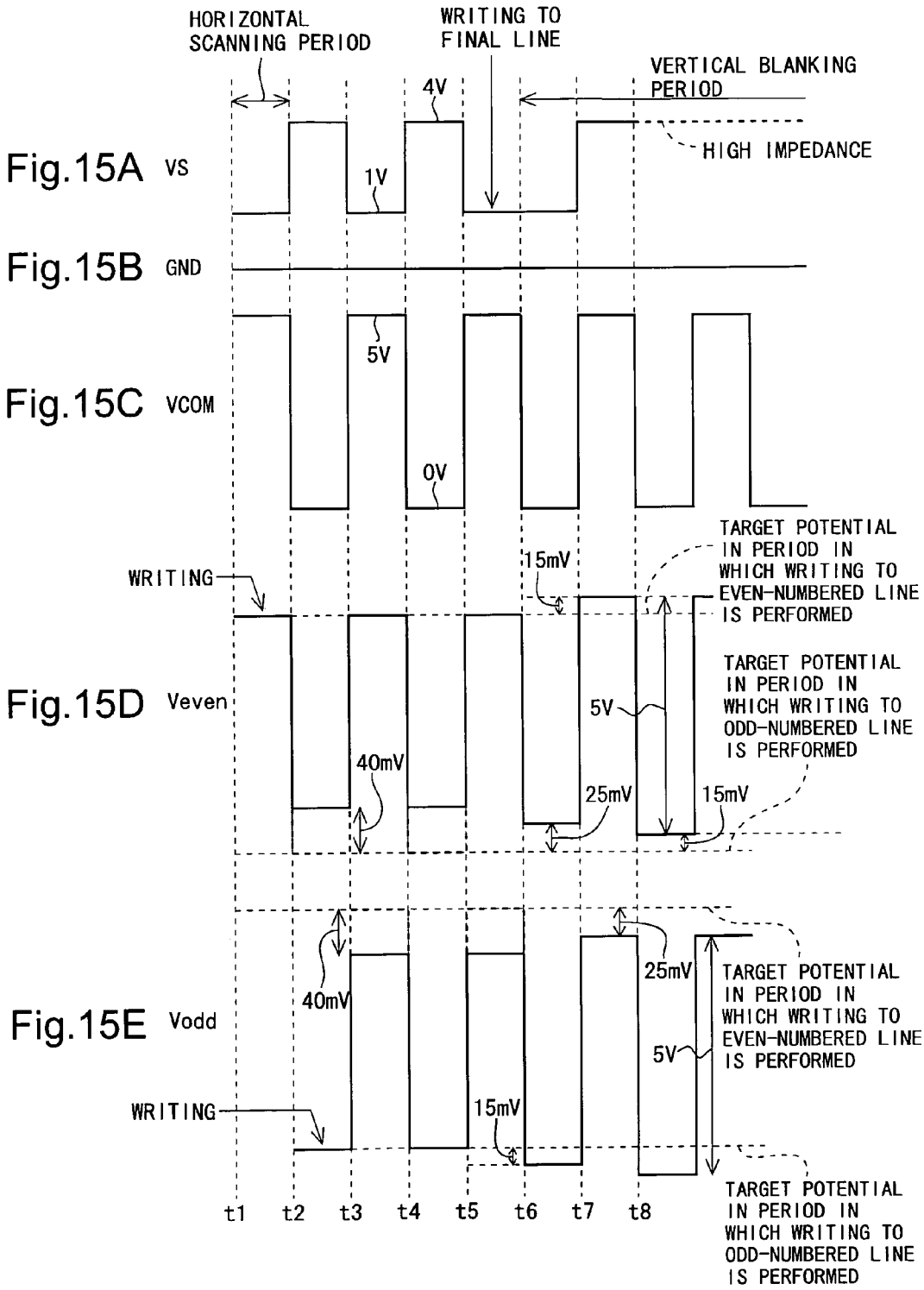
HORIZONTAL SCANNING PERIOD
WRITING TO FINAL LINE
VERTICAL BLANKING PERIOD
4V
HIGH IMPEDANCE
Fig.15A VS
1V
Fig.15B GND
5V
Fig.15C VCOM
0V
TARGET POTENTIAL IN PERIOD IN WHICH WRITING TO EVEN-NUMBERED LINE IS PERFORMED
15mV
WRITING
TARGET POTENTIAL IN PERIOD IN WHICH WRITING TO ODD-NUMBERED LINE IS PERFORMED
Fig.15D Veven
5V
40mV
25mV
15mV
25mV
TARGET POTENTIAL IN PERIOD IN WHICH WRITING TO EVEN-NUMBERED LINE IS PERFORMED
40mV
Fig.15E Vodd
5V
WRITING
15mV
t1 t2 t3 t4 t5 t6 t7 t8
TARGET POTENTIAL IN PERIOD IN WHICH WRITING TO ODD-NUMBERED LINE IS PERFORMED

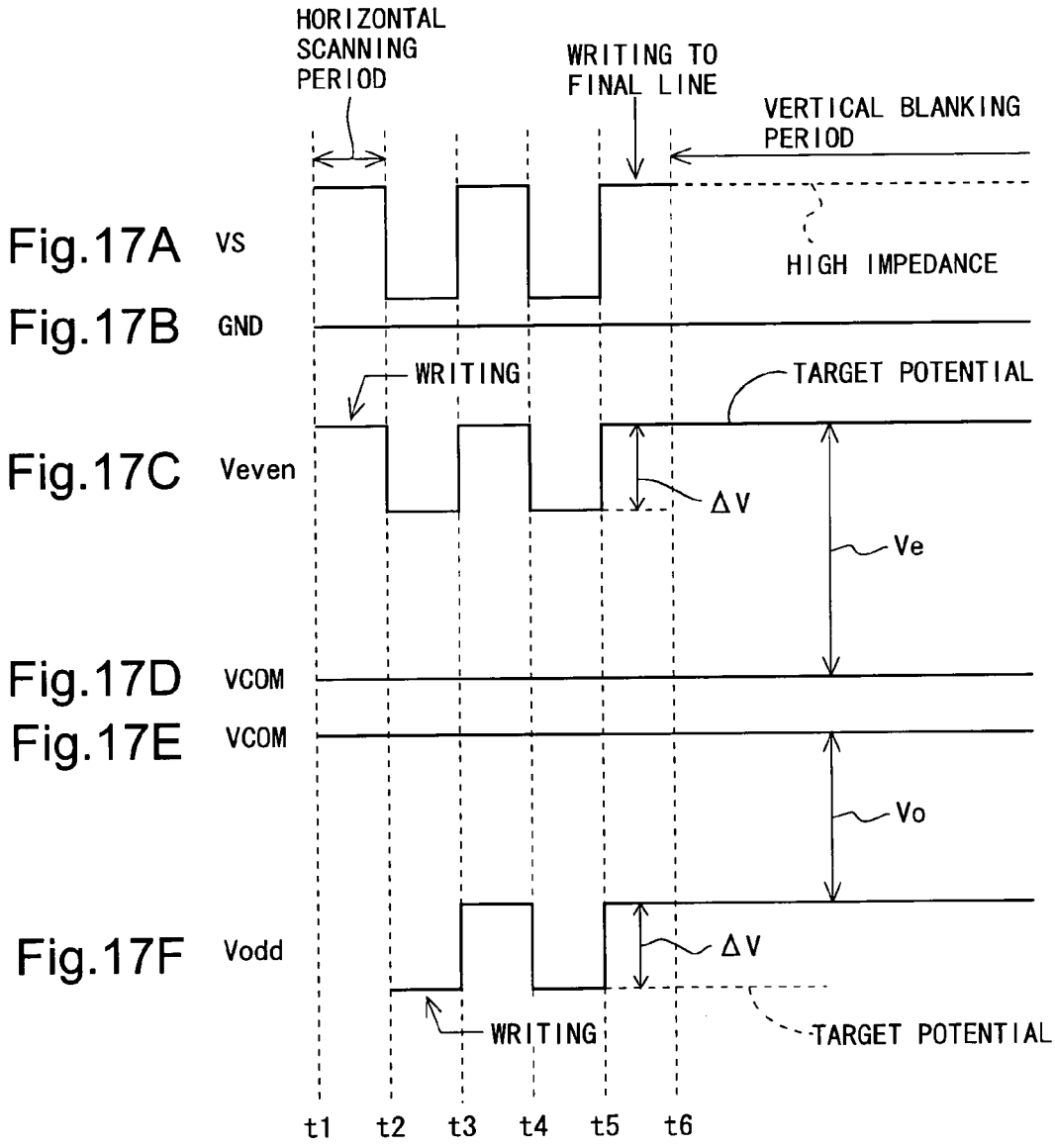
HORIZONTAL SCANNING PERIOD
WRITING TO FINAL LINE
VERTICAL BLANKING PERIOD
Fig.17A VS
HIGH IMPEDANCE
Fig.17B GND
WRITING
TARGET POTENTIAL
Fig.17C Veven
ΔV
Ve
Fig.17D VCOM
Fig.17E VCOM
Vo
Fig.17F Vodd
ΔV
WRITING
TARGET POTENTIAL
t1 t2 t3 t4 t5 t6

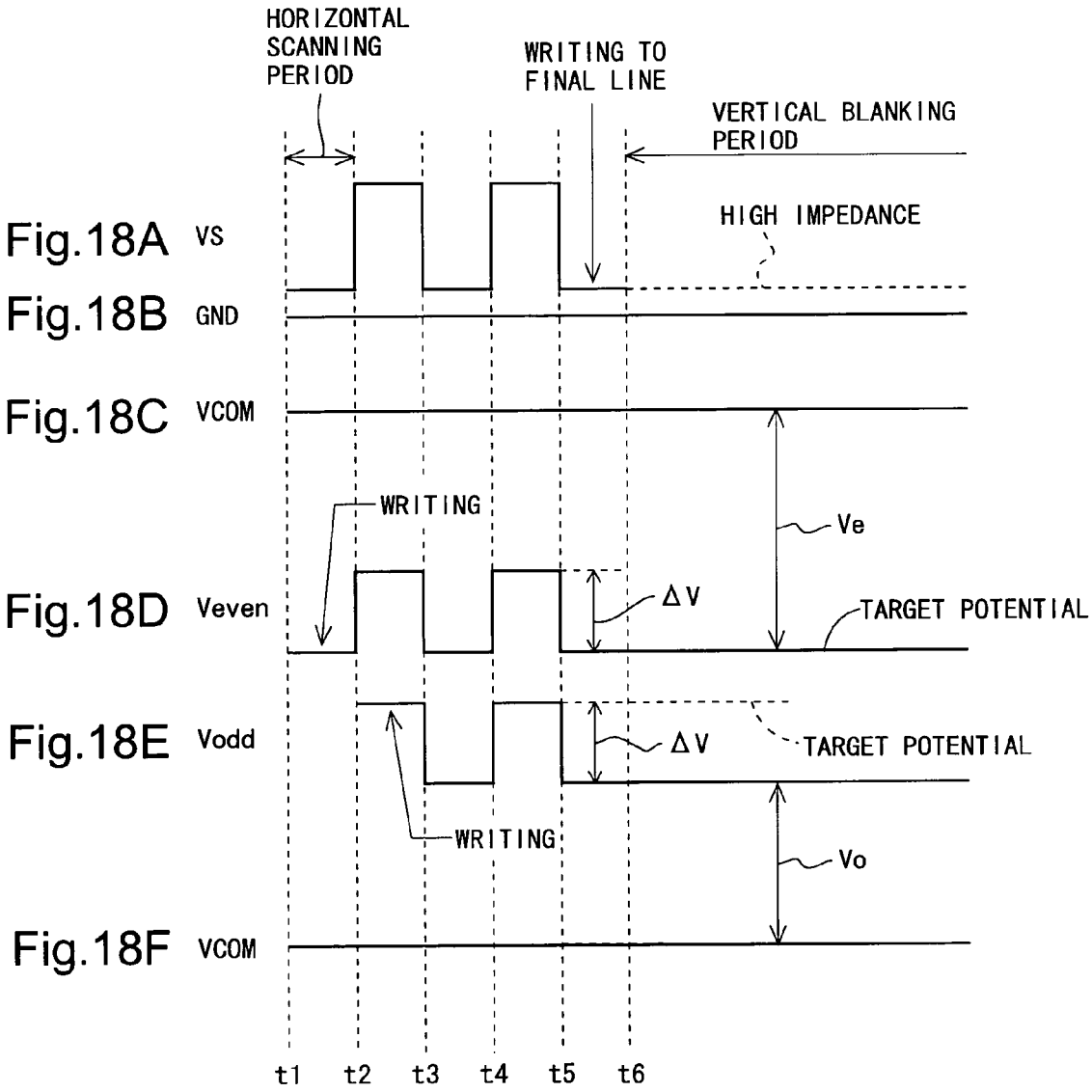
HORIZONTAL SCANNING PERIOD
WRITING TO FINAL LINE
VERTICAL BLANKING PERIOD
HIGH IMPEDANCE
Fig.18A VS
Fig.18B GND
Fig.18C VCOM
WRITING
Ve
Fig.18D Veven
ΔV
TARGET POTENTIAL
Fig.18E Vodd
ΔV
TARGET POTENTIAL
WRITING
Vo
Fig.18F VCOM
t1
t2
t3
t4
t5
t6

DISPLAY DEVICE, ITS DRIVING CIRCUIT, AND DRIVING METHOD

TECHNICAL FIELD

The present invention relates to a display device and, more particularly, to an active matrix-type display device employing a line inversion drive scheme as a drive scheme.

BACKGROUND ART

In recent years, an active matrix-type liquid crystal display device having a TFT (Thin Film Transistor) as a switching element is known. A display unit of an active matrix-type liquid crystal display device includes a plurality of source bus lines (video signal lines), a plurality of gate bus lines (scanning signal lines), and a plurality of pixel formation portions provided at the intersections of the plurality of source bus lines and the plurality of gate bus lines. The pixel formation portions are disposed in a matrix to form a pixel array.

FIG. 16 is a circuit diagram showing the configuration of the pixel formation portion in the active matrix-type liquid crystal display device. As shown in FIG. 16, each pixel formation portion includes: a TFT 10 having a gate electrode 11 connected to a gate bus line GL passing a corresponding intersection and a source electrode 12 connected to a source bus line SL passing the intersection; a pixel electrode 14 connected to a drain electrode 13 of the TFT 10; a common electrode 16 and an auxiliary capacitance electrode 18 commonly provided for the plurality of pixel formation portions; a liquid crystal capacitance 15 formed by the pixel electrode 14 and the common electrode 16; and an auxiliary capacitance 17 formed by the pixel electrode 14 and the auxiliary capacitance electrode 18. A pixel capacitance Cp is formed by the liquid crystal capacitance 15 and the auxiliary capacitance 17. A voltage indicative of the pixel value is held in the pixel capacitance Cp based on a video signal which is received by the source electrode 12 of each of the TFT 10 from the source bus line SL when the gate electrode 11 of the TFT 10 receives an active scan signal from the gate bus line GL.

By the way, since the pixel electrode 14 and the source bus line SL are disposed in positions close to each other, as shown in FIG. 16, a parasitic capacitance 19 exists between the pixel electrode 14 and the source bus line SL. In a display device employing the line inversion drive scheme, the polarity of potential of the pixel electrode 14 with respect to the potential of the common electrode 16 is inverted every line. Consequently, when entire-surface uniform brightness display is performed, the potential of a video signal fluctuates every horizontal scanning period. At this time, due to the influence of the parasitic capacitance 19, fluctuations in potential occur also in the pixel electrode 14 connected to the pixel capacitance Cp in which data is already written. As a result, a stripe (line in the horizontal direction) may be visually recognized on the screen. This will be described below with reference to FIGS. 17 and 18. Note that in the following, when a component in a pixel formation portion provided at a intersection between a k-th (k denotes "1", "2", . . . or "even-numbered" or "odd-numbered") gate bus line and an arbitrary source bus line is mentioned, it will be simply described as "(component name or the like) in the k-th line" (for example, "pixel electrode in an odd-numbered line").

FIG. 17 is a signal waveform diagram in a certain frame ("even-numbered frame" in this case) and FIG. 18 is a signal waveform diagram in the following frame ("odd-numbered frame" in this case). Note that it is assumed that data is written to the final line in the period (horizontal scanning period) from time point t5 to time point t6, and the final line is an even-numbered line. With respect to the writing to the final line, it is assumed that writing of the positive polarity is performed in even-numbered frames, and writing of the negative polarity is performed in odd-numbered frames.

FIGS. 17A and 17B and FIGS. 18A and 18B show fluctuations in a potential VS of the source electrode 12 (hereinafter, referred to as a "source potential") with respect to a ground potential GND. FIGS. 17C and 17D and FIGS. 18C and 18D show fluctuations in a potential Veven of the pixel electrode 14 in an even-numbered line (hereinafter, referred to as a "pixel potential") with respect to a potential VCOM of the common electrode 16 (hereinafter, referred to as a "common electrode potential"). Further, FIGS. 17E and 17F and FIGS. 18E and 18F show fluctuations in a pixel potential Vodd of an odd-numbered line with respect to the potential VCOM of the common electrode 16. Note that a delay in the change in the potential at each time point is ignored for convenience of explanation.

First, attention is paid to an even-numbered frame. As shown in FIG. 17A, with respect to the source potentials VS, in a horizontal scanning period until time point t6, high potential and low potential appear alternately. In a vertical blanking period at the time point t6 and later, the source bus line SL is set to the high-impedance state. When data is written in an even-numbered line in the horizontal scanning period from time point t1 to time point t2, the pixel potential Veven in the even-numbered line changes as shown in FIG. 17C. Further, when data is written in an odd-numbered line in the horizontal scanning period from time point t2 to time point t3, the pixel potential Vodd in the odd-numbered line changes as shown in FIG. 17F. Note that the pixel potential Vodd in an odd-numbered line in the horizontal scanning period from time point t1 to time point t2 is on the positive polarity side with respect to the common electrode potential VCOM, but it is not shown for convenience of explanation.

When attention is paid to changes in the pixel potential Veven in an even-numbered line, after the horizontal scanning period in which data is written, the potential drops by ΔV from a target potential in the horizontal scanning period in which data is written in an odd-numbered line, and the potential rises to the target potential in the following horizontal scanning period, that is, a horizontal scanning period in which data is written in an even-numbered line. On the other hand, when attention is paid to changes in the pixel potential Vodd in an odd-numbered line, after the horizontal scanning period in which data is written, the potential rises by ΔV from the target potential in the horizontal scanning period in which data is written in an even-numbered line, and the potential drops to the target potential in the following horizontal scanning period, that is, a horizontal scanning period in which data is written in an odd-numbered line. Moreover, in a vertical blanking period after completion of writing to the final line, as described above, the source bus line is set to the high-impedance state. Consequently, when the final line is an even-numbered line, the pixel potential Veven of an even-numbered line in the vertical blanking period is maintained as the target potential, but the pixel potential Vodd in an odd-numbered line in the vertical blanking period is maintained as potential higher than the target potential by ΔV. Therefore, in the vertical blanking period, a voltage Ve applied to the liquid crystal in an even-numbered line is maintained as the target voltage, and a voltage Vo applied to the liquid crystal in an odd-numbered line is maintained as a voltage lower than the target voltage by ΔV. Note that in the case where the final line is an odd-numbered line, in the vertical blanking period, the voltage applied to the liquid crystal in an even-numbered line is maintained as a voltage lower than the target voltage by ΔV, and the voltage applied to the liquid crystal in an odd-numbered line is maintained as the target voltage.

Next, attention is paid to an odd-numbered frame. As shown in FIGS. 18A to 18F, the polarity of writing to an even-numbered line and the polarity of writing to an odd-numbered line are opposite to those in an even-numbered frame. However, also in the odd-numbered frame, in the vertical blanking period, the voltage Ve applied to the liquid crystal in an even-numbered line is maintained as a target voltage, and the voltage Vo applied to the liquid crystal in an odd-numbered line is maintained to be lower than the target voltage by ΔV.

As described above, in both of the even-numbered and odd-numbered frames, during the vertical blanking period, a voltage difference of ΔV occurs between the voltage Ve applied to the liquid crystal in an even-numbered line and the voltage Vo applied to the liquid crystal in an odd-numbered line. As a result, as described above, a stripe (line in the horizontal direction) is visually recognized.

As for this, Japanese Laid-open Patent Publication No. 2001-202066 discloses an invention of an image display device which suppresses occurrence of a stripe by supplying a video signal to a source bus line during the vertical blanking period. In addition, Japanese Laid-open Patent Publication No. 2005-62535 discloses an invention of a liquid crystal display device which prevents occurrence of display unevenness by providing a signal line selecting circuit for switching and connecting a plurality of signal lines to a single source bus line.

[Patent Document 1] Japanese Laid-open Patent Publication No. 2001-202066

[Patent Document 2] Japanese Laid-open Patent Publication No. 2005-62535

DISCLOSURE OF THE INVENTION

Problems to be Solved by the Invention

According to the inventions disclosed in Japanese Laid-open Patent Publication Nos. 2001-202066 and 2005-62535, however, a video signal has to be supplied to the source bus line also in the vertical blanking period, so that power consumption increases.

Therefore, an object of the present invention is to provide a display device capable of suppressing occurrence of display unevenness (stripe) without increasing power consumption.

Means for Solving the Problems

A first aspect of the present invention is directed to an active matrix-type display device including:

a plurality of video signal lines for transmitting a video signal based on an image to be displayed;

a plurality of scanning signal lines crossing the plurality of video signal lines;

a plurality of switch elements disposed in a matrix respectively in correspondence with intersections of the plurality of video signal lines and the plurality of scanning signal lines;

a plurality of pixel electrodes respectively connected to the plurality of switch elements;

a common electrode commonly provided for the plurality of pixel electrodes;

a video signal line driving circuit for applying the video signal to the plurality of video signal lines so that polarity of potential of the plurality of pixel electrodes for the potential of the common electrode is inverted every predetermined number of horizontal scanning periods; and a transition period video signal potential determining unit for determining potential of a video signal to be applied to the plurality of video signal lines in a transition period in a frame period made of an effective video period and a vertical blanking period and in which displaying an image of one frame is performed, the transition period being a period in which a predetermined time is passed from start time point of the vertical blanking period.

According to a second aspect of the present invention, in the first aspect of the present invention, from end time point of the transition period in preceding frame period of two successive frame periods to start point of the effective video period in the subsequent frame period, the video signal line driving circuit and the plurality of video signal lines are electrically separated from each other.

According to a third aspect of the present invention, in the first aspect of the present invention, the transition period video signal potential determining unit determines potential of a video signal to be applied to the plurality of video signal lines in the transition period based on a change in potential of a video signal in the effective video period.

According to a fourth aspect of the present invention, in the third aspect of the present invention, the transition period video signal potential determining unit determines potential of a video signal to be applied to the plurality of video signal lines in the transition period so that a change in potential between video signals before and after the start point of the vertical blanking period becomes the half of a change in potential of a video signal in the effective video period.

According to a fifth aspect of the present invention, in the first aspect of the present invention, the transition period video signal potential determining unit determines to set potential of a video signal to be applied to the plurality of video signal lines in the transition period to a median potential of maximum and minimum potentials of video signals which is applied from the video signal line driving circuit to the plurality of video signal lines.

According to a sixth aspect of the present invention, in the first aspect of the present invention, the transition period video signal potential determining unit determines potential of a video signal to be applied to the plurality of video signal lines in the transition period so that, in first and second frame periods as successive two frame periods, a potential of a video signal at the end time point of the transition period in the first frame period and a potential of a video signal at the end time point of the transition period in the second frame period become almost equal to each other.

According to a seventh aspect of the present invention, in the sixth aspect of the present invention, potential of the common electrode is set to be high potential and low potential alternately every the predetermined number of horizontal scanning periods, length of the transition period in the first frame period and length of the transition period in the second frame period are set to be different from each other, and the transition period video signal potential determining unit determines potential of a video signal to be applied to the plurality of video signal lines in the transition period so that, when potential of the common electrode is set as high potential immediately after start of the transition period in the first frame period, potential of the video signal at the end time point of the transition period in the first frame period becomes equal to maximum potential of the video signal in the effective video period and potential of the video signal at the end time point of the transition period in the second frame period becomes equal to maximum potential of the video signal in the effective video period, and determines potential of a video signal to be applied to the plurality of video signal lines in the transition period so that, when potential of the common electrode is set as low potential immediately after start of the transition period in the first frame period, potential of the video signal at the end time point of the transition period in the first frame period becomes equal to minimum potential of the video signal in the effective video period and potential of the video signal at the end time point of the transition period in the second frame period becomes equal to minimum potential of the video signal in the effective video period.

According to an eighth aspect of the present invention, in the seventh aspect of the present invention, length of the transition period in the first frame period is set to be equal to length of the predetermined number of horizontal scanning periods as an interval in which polarity of potential of the plurality of pixel electrodes with respect to potential of the common electrode is inverted, and length of the transition period in the second frame period is set to length which is twice as long as the length of the transition period in the first frame period.

A ninth aspect of the present invention is directed to a display device for performing display in a normally black mode, the display device being the display device according to the sixth aspect of the present invention, wherein the transition period video signal potential determining unit determines potential of a video signal to be applied to the plurality of video signal lines in the transition period so that potential of a video signal at the end time point of the transition period in the first frame period becomes potential for displaying black, and potential of a video signal at the end time point of the transition period in the second frame period becomes potential for displaying black.

A tenth aspect of the present invention is directed to a display device for performing display in a normally white mode, the display device being the display device according to the sixth aspect of the present invention, wherein the transition period video signal potential determining unit determines potential of a video signal to be applied to the plurality of video signal lines in the transition period so that potential of a video signal at the end time point of the transition period in the first frame period becomes potential for displaying white, and potential of a video signal at the end time point of the transition period in the second frame period becomes potential for displaying white.

According to an eleventh aspect of the present invention, in the first aspect of the present invention, polarity of potential of the plurality of pixel electrodes with respect to potential of the common electrode is inverted every one horizontal scanning period.

A twelfth aspect of the present invention is directed to a display device for performing display in a normally black mode, the display device being the display device according to the first aspect of the present invention, wherein the transition period video signal potential determining unit determines potential of a video signal to be applied to the plurality of video signal lines in the transition period so that potential of a video signal at the end time point of the transition period becomes potential for displaying black.

A thirteenth aspect of the present invention is directed to a display device for performing display in a normally white mode, the display device being the display device according to the first aspect of the present invention, wherein the transition period video signal potential determining unit determines potential of a video signal to be applied to the plurality of video signal lines in the transition period so that potential of a video signal at the end time point of the transition period becomes potential for displaying white.

A fourteenth aspect of the present invention is directed to a driving circuit of an active matrix-type display device including a plurality of video signal lines for transmitting a video signal based on an image to be displayed, a plurality of scanning signal lines crossing the plurality of video signal lines, a plurality of switch elements disposed in a matrix respectively in correspondence with intersections of the plurality of video signal lines and the plurality of scanning signal lines, a plurality of pixel electrodes respectively connected to the plurality of switch elements, and a common electrode commonly provided for the plurality of pixel electrodes, the driving circuit including:

a video signal line driving circuit for applying the video signal to the plurality of video signal lines so that polarity of potential of the plurality of pixel electrodes for the potential of the common electrode is inverted every predetermined number of horizontal scanning periods; and a transition period video signal potential determining unit provided on the inside or outside of the video signal line driving circuit and determining potential of a video signal to be applied to the plurality of video signal lines in a transition period in a frame period made of an effective video period and a vertical blanking period and in which displaying an image of one frame is performed, the transition period being a period in which a predetermined time is passed from start time point of the vertical blanking period.

In the fourteenth aspect of the present invention, a modification grasped by referring to the embodiment and the drawings is considered as means for solving the problem.

A twenty-second aspect of the present invention is directed to a driving method of an active matrix-type display device including a plurality of video signal lines for transmitting a video signal based on an image to be displayed, a plurality of scanning signal lines crossing the plurality of video signal lines, a plurality of switch elements disposed in a matrix respectively in correspondence with intersections of the plurality of video signal lines and the plurality of scanning signal lines, a plurality of pixel electrodes respectively connected to the plurality of switch elements, and a common electrode commonly provided for the plurality of pixel electrodes, the method including:

a video signal line driving step of applying the video signal to the plurality of video signal lines so that polarity of potential of the plurality of pixel electrodes for the potential of the common electrode is inverted every predetermined number of horizontal scanning periods; and a transition period video signal potential determining step of determining potential of a video signal to be applied to the plurality of video signal lines in a transition period in a frame period made of an effective video period and a vertical blanking period and in which displaying an image of one frame is performed, the transition period being a period in which a predetermined time is passed from start time point of the vertical blanking period.

In the twenty-second aspect of the present invention, a modification grasped by referring to the embodiment and the drawings is considered as means for solving the problem.

Effects of the Invention

According to the first aspect of the present invention, the display device employing one 1-line or plural-line inversion drive scheme is provided with the transition period video signal potential determining unit for determining potential of a video signal to be applied to a video signal line in a period of predetermined time elapsed since start time point of a vertical blanking period (transition period). Consequently, it can be configured that after completion of writing to all of lines a predetermined video signal is applied to a video signal line. Therefore, for example, it can be configured that a video signal is applied to a video signal line after start of the vertical blanking period so that the difference among lines in magnitude of fluctuations in the pixel electrode potential due to the influence of parasitic capacitance between a pixel electrode and a video signal line decreases. As a result, the difference of fluctuation amounts of the pixel electrode potentials in lines is decreased and occurrence of display unevenness visually recognized as a stripe (line in the horizontal direction) on the screen can be suppressed.

According to a second aspect of the present invention, inmost of the vertical blanking period, the video signal line driving circuit and the video signal lines are electrically separated from each other. Consequently, in most of the vertical blanking period, supply of a video signal to a video signal line is unnecessary. Therefore, while reducing power consumption, in a manner similar to the first invention, occurrence of display unevenness can be suppressed.

According to a third aspect of the present invention, potential of a video signal in a transition period is determined based on a change in potential of a video signal in an effective video period. Consequently, a video signal of preferred potential according to brightness of a display image is applied to a video signal line in the transition period, and occurrence of display unevenness is suppressed efficiently.

According to a fourth aspect of the present invention, potential of a video signal in the transition period can be determined easily. Therefore, with a simple configuration, occurrence of display unevenness can be suppressed efficiently.

According to a fifth aspect of the present invention, irrespective of a change in potential of a video signal in the effective video period, potential of a video signal in the transition period can be determined. Therefore, with a simple configuration, occurrence of display unevenness can be suppressed efficiently.

According to a sixth aspect of the present invention, in a first frame period and in a second frame period which are two successive frame periods, the potentials of the video signal at the end time point of the transition period are set almost equal to each other. Consequently, when there is some restriction in setting of the potential of a video signal, a video signal of preferred potential is applied to a video signal line in the transition period so as to suppress occurrence of display unevenness using the two frame periods as one unit.

According to a seventh aspect of the present invention, in the display device in which common electrode inverting drive is performed, when there is some restriction in setting of the potential of a video signal, a video signal of preferred potential is applied to a video signal line in the transition period so as to suppress occurrence of display unevenness using the two frame periods as one unit.

According to an eighth aspect of the present invention, in a manner similar to the seventh invention, in the display device in which common electrode inverting drive is performed, when there is some restriction in setting of the potential of a video signal, a video signal of preferred potential is applied to a video signal line in the transition period so as to suppress occurrence of display unevenness using the two frame periods as one unit.

According to a ninth aspect of the present invention, in a display device for performing display in a normally black mode, occurrence of display unevenness is suppressed using two frame periods as one unit.

According to a tenth aspect of the present invention, in a display device for performing display in a normally white mode, occurrence of display unevenness is suppressed using two frame periods as one unit.

BRIEF DESCRIPTION OF THE DRAWINGS

FIGS. 5A to 5F are signal waveform diagrams in an odd-numbered frame in the first embodiment.

FIGS. 7A to 7F are signal waveform diagrams in an even-numbered frame in a modification of the first embodiment.

FIGS. 8A to 8F are signal waveform diagrams in an even-numbered frame in a second embodiment of the present invention.

FIGS. 9A to 9F are signal waveform diagrams in an odd-numbered frame in the second embodiment.

FIGS. 10A to 10F are signal waveform diagrams in an even-numbered frame showing a concrete example of values of voltages and potentials in the second embodiment.

FIGS. 11A to 11F are signal waveform diagrams in an odd-numbered frame showing a concrete example of values of voltages and potentials in the second embodiment.

FIGS. 12A to 12E are signal waveform diagrams in an even-numbered frame in a third embodiment of the present invention.

FIGS. 13A to 13E are signal waveform diagrams in an odd-numbered frame in the third embodiment.

FIGS. 14A to 14E are signal waveform diagrams in an even-numbered frame showing a concrete example of values of voltages and potentials in the third embodiment.

FIGS. 15A to 15E are signal waveform diagrams in an odd-numbered frame showing a concrete example of values of voltages and potentials in the third embodiment.

FIGS. 17A to 17F are signal waveform diagrams in an even-numbered frame in the conventional technique.

FIGS. 18A to 18F are signal waveform diagrams in an odd-numbered frame in the conventional technique.

DESCRIPTION OF REFERENCE NUMERALS

Figure 1:
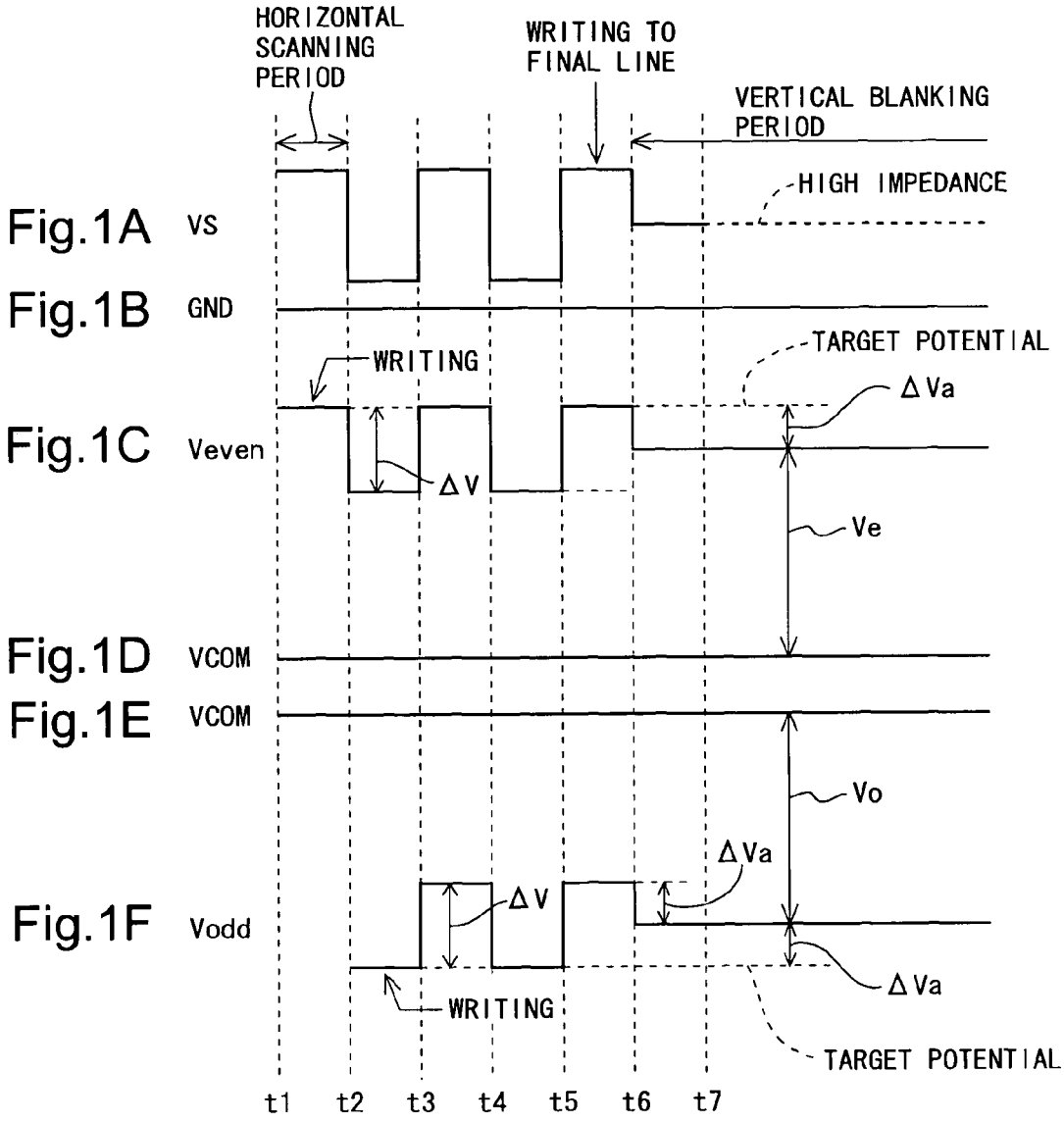
FIGS. 1A to 1F are signal waveform diagrams in an even-numbered frame in a liquid crystal display device in a first embodiment of the present invention.

10: TFT (switching element)
31: Data processing circuit
100: Display unit
200: Display control circuit
300: Source driver (video signal line driving circuit)
311: Counter unit
312: Data switch instructing unit
313: Data switching unit
314: Data value calculating unit
400: Gate driver (scanning signal line driving circuit)

GND: Ground potential
VCOM: Common electrode potential
Veven Potential of pixel electrode in even-numbered line
Vodd: Potential of pixel electrode in odd-numbered line
VS: Potential of source electrode

BEST MODE FOR CARRYING OUT THE INVENTION

Embodiments of the present invention will be described below with reference to the accompanying drawings.

1. First Embodiment

1.1 General Configuration and Operation

Figure 2:
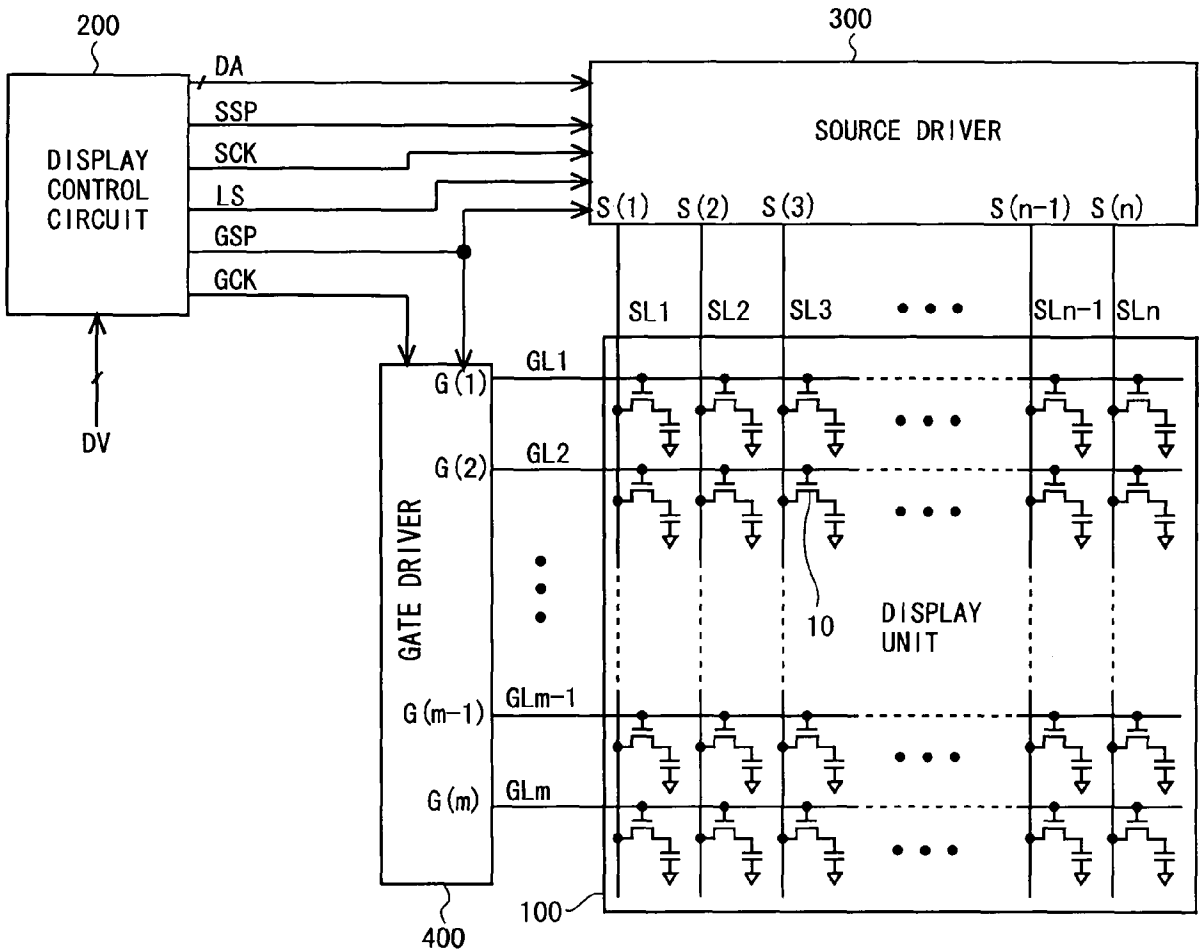
FIG. 2 is a block diagram showing a general configuration of the liquid crystal display device in the first embodiment.

FIG. 2 is a block diagram showing a general configuration of a liquid crystal display device in a first embodiment of the present invention. The liquid crystal display device has a display unit 100, a display control circuit 200, a source driver (video signal line driving circuit) 300, and a gate driver (scanning signal line driving circuit) 400.

The display unit 100 includes a plurality of (n) source bus lines (video signal lines) SL1 to SLn, a plurality of (m) gate bus lines (scanning signal lines) GL1 to GLm, and a plurality of (n×m) pixel formation portions provided in correspondence with intersections of the plurality of source bus lines SL1 to SLn and the plurality of gate bus lines GL1 to GLm. The pixel formation portions are disposed in a matrix and form a pixel array. Each of the pixel formation portions includes: a TFT 10 as a switch element whose gate electrode is connected to a gate bus line GLj passing a corresponding intersection and whose source electrode is connected to a source bus line SLi passing the intersection; a pixel electrode connected to a drain electrode of the TFT 10; a common electrode and an auxiliary capacitance electrode which are commonly provided for the plurality of pixel formation portions; a liquid crystal capacitance formed by the pixel electrode and the common electrode; and an auxiliary capacitance formed by the pixel electrode and the auxiliary capacitance electrode. The pixel capacitance is formed by the liquid crystal capacitance and the auxiliary capacitance.

The display control circuit 200 receives a digital video signal DV showing an image to be displayed, and outputs a digital image signal DA (a signal corresponding to the digital video signal DV); and a source start pulse signal SSP, a source clock signal SCK, a latch strobe signal LS, a gate start pulse signal GSP, and a gate clock signal GCK which are used to control image display in the display unit 100. The source driver 300 receives the digital image signal DA, the source start pulse signal SSP, the source clock signal SCK, the latch strobe signal LS, and the gate start pulse signal GSP outputted from the display control circuit 200, and applies video signals S(1) to S(n) for driving to the source bus lines SL1 to SLn, respectively. The gate driver 400 repeats application of active scan signals G(1) to G(m) to the gate bus lines GL1 to GLm every frame period (one vertical scanning period) based on the gate start pulse signal GSP and the gate clock signal GCK outputted from the display control circuit 200.

As described above, the video signals for driving are applied to the source bus lines SL1 to SLn and scan signals are applied to the gate bus lines GL1 to GLm, thereby displaying an image on the display unit 100.

1.2 Configuration of Source Driver

Figure 3:
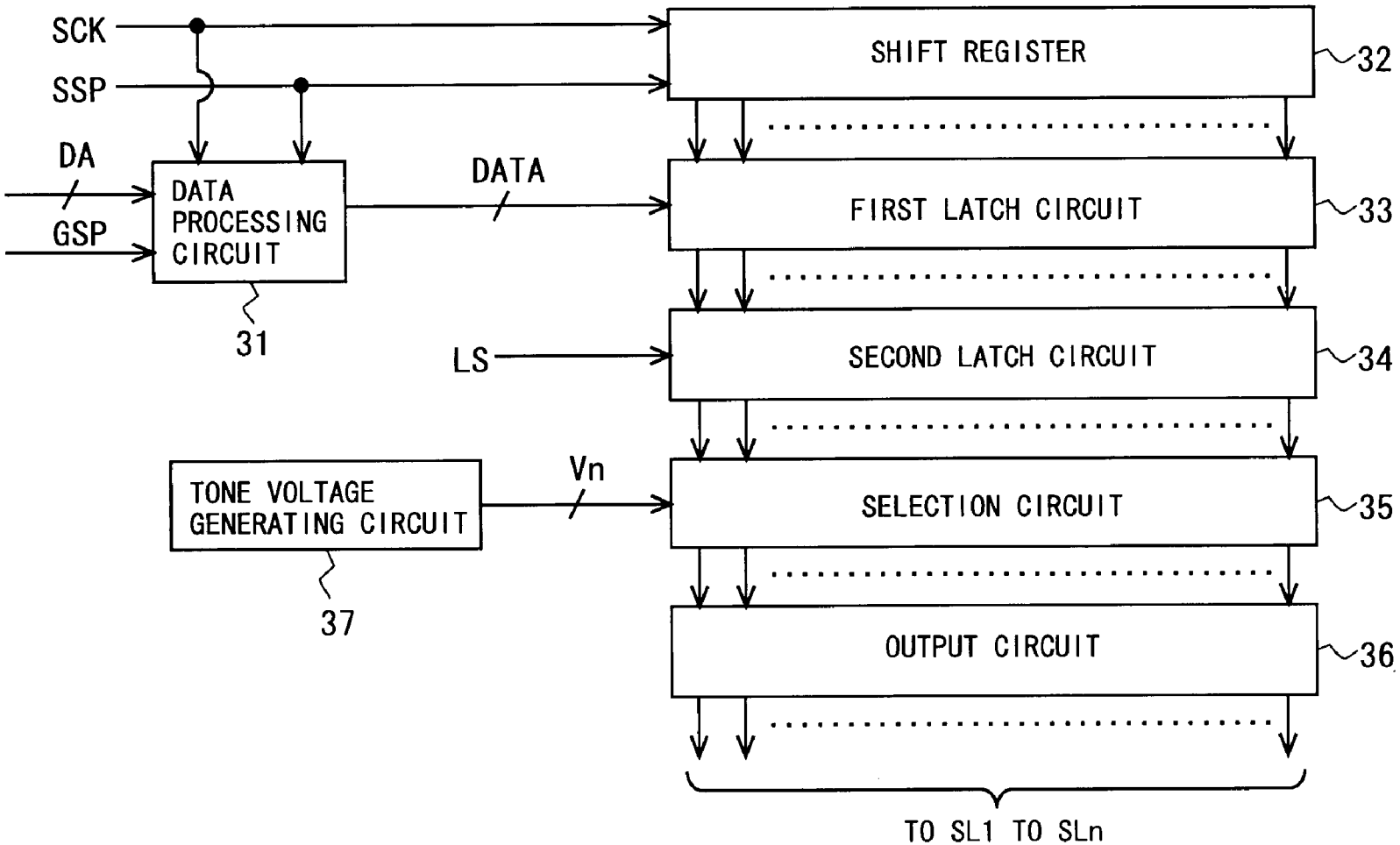
FIG. 3 is a block diagram showing the configuration of a source driver in the first embodiment.

FIG. 3 is a block diagram showing the configuration of the source driver 300 in the embodiment. The source driver 300 includes a data processing circuit 31, a shift register 32, a first latch circuit 33, a second latch circuit 34, a selection circuit 35, an output circuit 36, and a tone voltage generating circuit 37. In the embodiment, a transition period video signal potential determining unit is realized by the data processing circuit 31.

The data processing circuit 31 receives the digital image signal DA, the source start pulse signal SSP, the source clock signal SCK, and the gate start pulse signal GSP transmitted from the display control circuit 200 and outputs a digital image signal DATA for generating a video signal for driving. The detailed configuration and operation of the data processing circuit 31 will be described later.

To the shift register 32, the source start pulse signal SSP and the source clock signal SCK are inputted. The shift register 32 sequentially transfers pulses included in the source start pulse signal SSP from an input end to an output end based on the signals SSP and SCK. In response to the transfer of the pulses, sampling pulses corresponding to the source bus lines SL1 to SLn are sequentially outputted from the shift register 32. The sampling pulses are sequentially inputted to the first latch circuit 33.

The first latch circuit 33 samples the digital image signals DATA outputted from the data processing circuit 31 at the timings of the sampling pulses. The second latch circuit 34 outputs the digital image signals DATA sampled by the first latch circuit 33 as internal image signals at the timing of the pulse of the latch strobe signal LS.

The tone voltage generating circuit 37 outputs, as atone voltage group Vn, voltages corresponding to, for example, 1,024 gray levels on each of the positive and negative polarities based on a plurality of reference voltages given from a predetermined power source circuit (not shown).

The selection circuit 35 selects any voltage in the tone voltage group Vn outputted from the tone voltage generating circuit 37 based on the internal image signals outputted from the second latch circuit 34 and outputs the selected voltage. The voltage outputted from the selection circuit 35 is inputted to the output circuit 36. The output circuit 36 performs impedance conversion on the voltage outputted from the selection circuit 35 by, for example, a voltage follower, and outputs the voltage subjected to the conversion as a video signal for driving to the source bus lines SL1 to SLn.

1.3 Configuration and Operation of Data Processing Circuit

Figure 4:
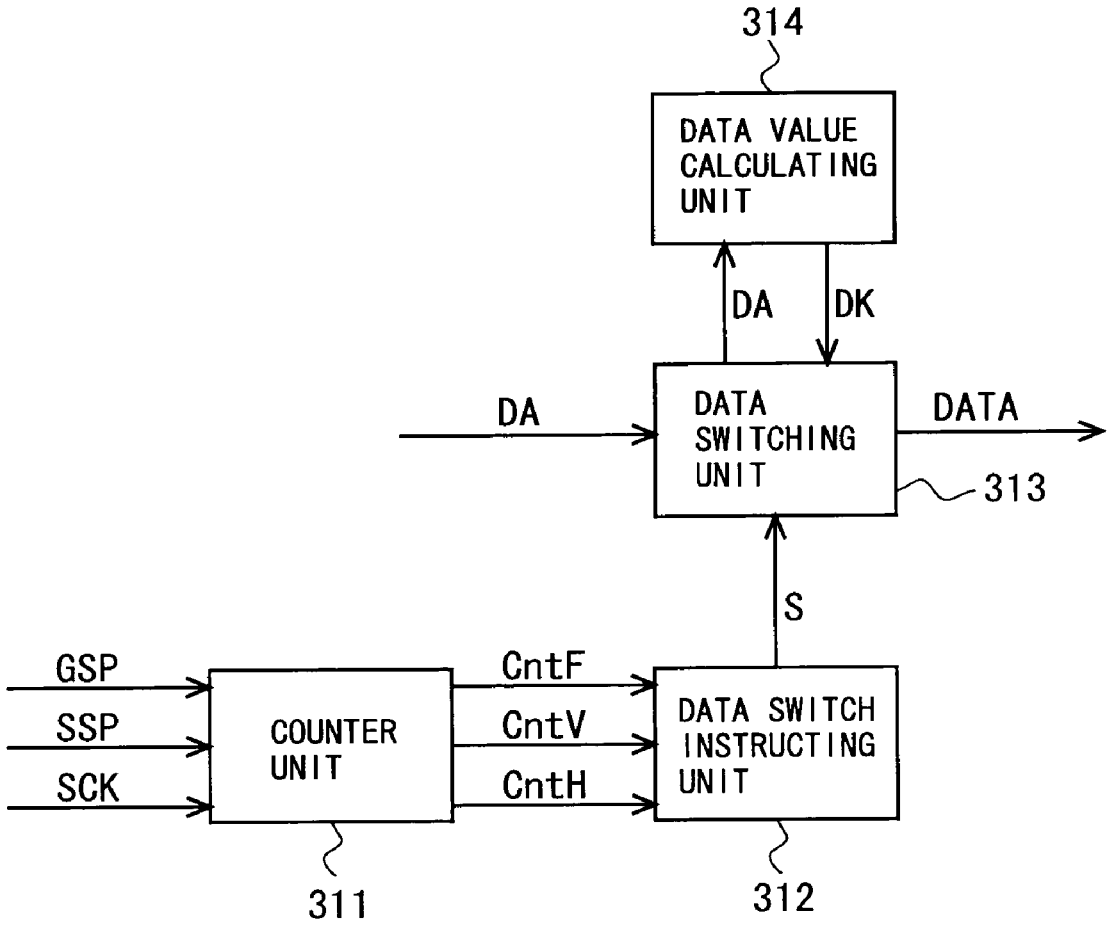
FIG. 4 is a block diagram showing the configuration of a data processing unit in the first embodiment.

FIG. 4 is a block diagram showing the configuration of the data processing circuit 31 in the embodiment. The data processing circuit 31 includes a counter unit 311, a data switch instructing unit 312, a data switching unit 313, and a data value calculating unit 314.

The counter unit 311 receives the gate start pulse signal GSP, the source start pulse signal SSP, and the source clock signal SCK outputted from the display control circuit 200. The counter unit 311 counts a value (hereinafter, referred to as an "F count value") CntF indicative of the number of a frame based on the gate start pulse signal GSP, counts a value (hereinafter, referred to as a "V count value") CntV indicative of the row of data (input data) based on the source start pulse signal SSP, counts a value (hereinafter, referred to as an "H count value") CntH indicative of the column of data (input data) based on the source clock signal SCK, and outputs CntF, CntV, and CntH.

The data value calculating unit 314 calculates a value (hereinafter, referred to as a "vertical blanking period potential value") DK indicative of potential of a video signal for driving to be applied to the source bus lines SL1 to SLn in the first horizontal scanning period in the vertical blanking period based on the digital image signal DA outputted from the display control circuit 200, and outputs the value DK.

The data switch instructing unit 312 receives the F count value CntF, the V count value CntV, and the H count value CntH which are outputted from the counter unit 311, and outputs the data switch instructing signal S for switching data to be used for generating a video signal for driving. Concretely, the data switch instruction signal S is outputted so that, in an effective video period (the period other than the vertical blanking period) in each frame, a video signal for driving is generated based on the digital image signal DA outputted from the display control circuit 200 and, in the first horizontal scanning period in the vertical blanking period in each frame, the video signal for driving is generated based on the vertical blanking period potential value DK calculated by the data value calculating unit 314.

The data switching unit 313 outputs, as the digital image signal DATA, the digital image signal DA outputted from the display control circuit 200 or the vertical blanking period potential value DK outputted from the data value calculating unit 314, based on the data switch instruction signal S outputted from the data switch instructing unit 312.

By the above-described operation of the data processing circuit 31, in the effective image period in each frame, the video signals for driving generated based on the digital image signal DA outputted from the display control circuit 200 are applied to the source bus lines SL1 to SLn, and in the first horizontal scanning period in the vertical blanking period in each frame, the video signals for driving generated based on the vertical blanking period potential value DK calculated by the data value calculating unit 314 are applied to the source bus lines SL1 to SLn. After completion of the first horizontal scanning period in the vertical blanking period in each frame, the source bus lines SL1 to SLn are set to a high-impedance state, that is, a state where the source driver 300 and the source bus lines SL1 to SLn are electrically isolated from each other.

1.4 Driving Method

A driving method in the embodiment will now be described with reference to FIGS. 1 and 5. FIG. 1 is a signal waveform diagram in an even-numbered frame. FIG. 5 is a signal waveform diagram in an odd-numbered frame. It is assumed that data is written to the final line in a horizontal scanning period from time point t5 to time point t6, and the final line is an even-numbered line. It is also assumed that uniform brightness display is performed on the whole surface and, with respect to writing to the final line, writing of the positive polarity is performed in an even-numbered frame, and writing of the negative polarity is performed in an odd-numbered frame. It is further assumed that delay in a change in the potential at each time point can be ignored.

First, attention is paid to an even-numbered frame. In a period until the time point t6 when the vertical blanking period starts (effective video period), operations similar to those of the conventional technique shown in FIG. 17 are performed. That is, with respect to the source potential VS, for brightness display based on the digital image signal DA outputted from the display control circuit 200, high potential and low potential appear alternately every horizontal scanning period as shown in FIG. 1A. Consequently, with respect to a pixel potential Veven of an even-numbered line, as shown in FIG. 1C, after a horizontal scanning period in which data is written, the potential drops by ΔV from a target potential in a horizontal scanning period in which data is written in an odd-numbered line, and the potential rises (returns) to the target potential in the next horizontal scanning period, that is, a horizontal scanning period in which data is written in an even-numbered line. On the other hand, with respect to a pixel potential Vodd of an odd-numbered line, as shown in FIG. 1F, after a horizontal scanning period in which data is written, the potential rises by ΔV from the target potential in a horizontal scanning period in which data is written in an even-numbered line, and the potential decreases (returns) to the target potential in the next horizontal scanning period, that is, a horizontal scanning period in which data is written in an odd-numbered line. As a result, just before the time point t6 when writing to the final line as an even-numbered line is finished, although the pixel potential Veven of an even-numbered line is equal to the target potential, a pixel potential Vodd of an odd-numbered line is higher than the target potential by ΔV.

At time point t6, the source potential VS drops by ½ of the amplitude in the period till the time point t6. The dropped potential is maintained only in one horizontal scanning period. At time point t7 or later, the source bus lines SL1 to SLn are in the high-impedance state. The value of the source potential VS in the horizontal scanning period from the time point t6 to the time point t7 is a value based on the vertical blanking period potential value DK.

As a result of the drop of the source potential VS at the time point t6 as described above, as shown in FIGS. 1C and 1F, both of the pixel potential Veven of an even-numbered line and the pixel potential Vodd of an odd-numbered line drop by ΔVa at the time point t6. The magnitude of changes in the pixel potentials Veven and Vodd based on a change in the source potential VS is proportional to a change amount of the source potential VS. As described above, the change amount of the source potential VS at the time point t6 is ½ of the amplitude in the period until the time point t6. Consequently, the magnitude of ΔVa corresponds to ½ of the magnitude of ΔV. So, at time point t7, the potential difference in an even-numbered line between the pixel potential Veven and the target potential and the potential difference in an odd-numbered line between the pixel potential Vodd and the target potential are almost equal to each other. At the time point t7 or later, the source bus lines SL1 to SLn are in the high-impedance state, so that the pixel potential Veven in an even-numbered line and the pixel potential Vodd in an odd-numbered line are maintained as they are. As a result, in the vertical blanking period, the voltage Ve applied to the liquid crystal in an even-numbered line and the voltage Vo applied to the liquid crystal in an odd-numbered line are almost equal to each other. As described above, in an even-numbered frame, the period from the time point t6 to the time point t7 is a transition period.

Next, attention is paid to an odd-numbered frame. In a period until the time point t6 when the vertical blanking period starts, as shown in FIG. 5, operations similar to those of the conventional technique shown in FIG. 18 are performed. As a result, just before the time point t6 when writing to the final line as an even-numbered line is finished, although the pixel potential Veven of an even-numbered line is equal to the target potential, the pixel potential Vodd of an odd-numbered line is lower than the target potential by ΔV.

At time point t6, the source potential VS rises by ½ of the amplitude in the period till the time point t6. The risen potential is maintained only in one horizontal scanning period. At time point t7 or later, the source bus lines SL1 to SLn are in the high-impedance state. By operations similar to those in the even-numbered frame, in the vertical blanking period, the voltage Ve applied to the liquid crystal in an even-numbered line and the voltage Vo applied to the liquid crystal in an odd-numbered line are almost equal to each other. As described above, also in an odd-numbered frame, the period from the time point t6 to the time point t7 is a transition period.

Note that in a liquid crystal display device for performing display in a normally black mode, the source potential VS in the horizontal scanning period from the time point t6 to the time point t7 in the even-numbered frame and the horizontal scanning period from the time point t6 to the time point t7 in the odd-numbered frame may be set to a potential for displaying black. Also, in a liquid crystal display device for performing display in a normally white mode, the source potential VS in the horizontal scanning period from the time point t6 to the time point t7 in the even-numbered frame and the horizontal scanning period from the time point t6 to the time point t7 in the odd-numbered frame may be set to a potential for displaying white.

1.5 Example

Figures 6A, 6B, 6C, 6D, 6E, 6F:
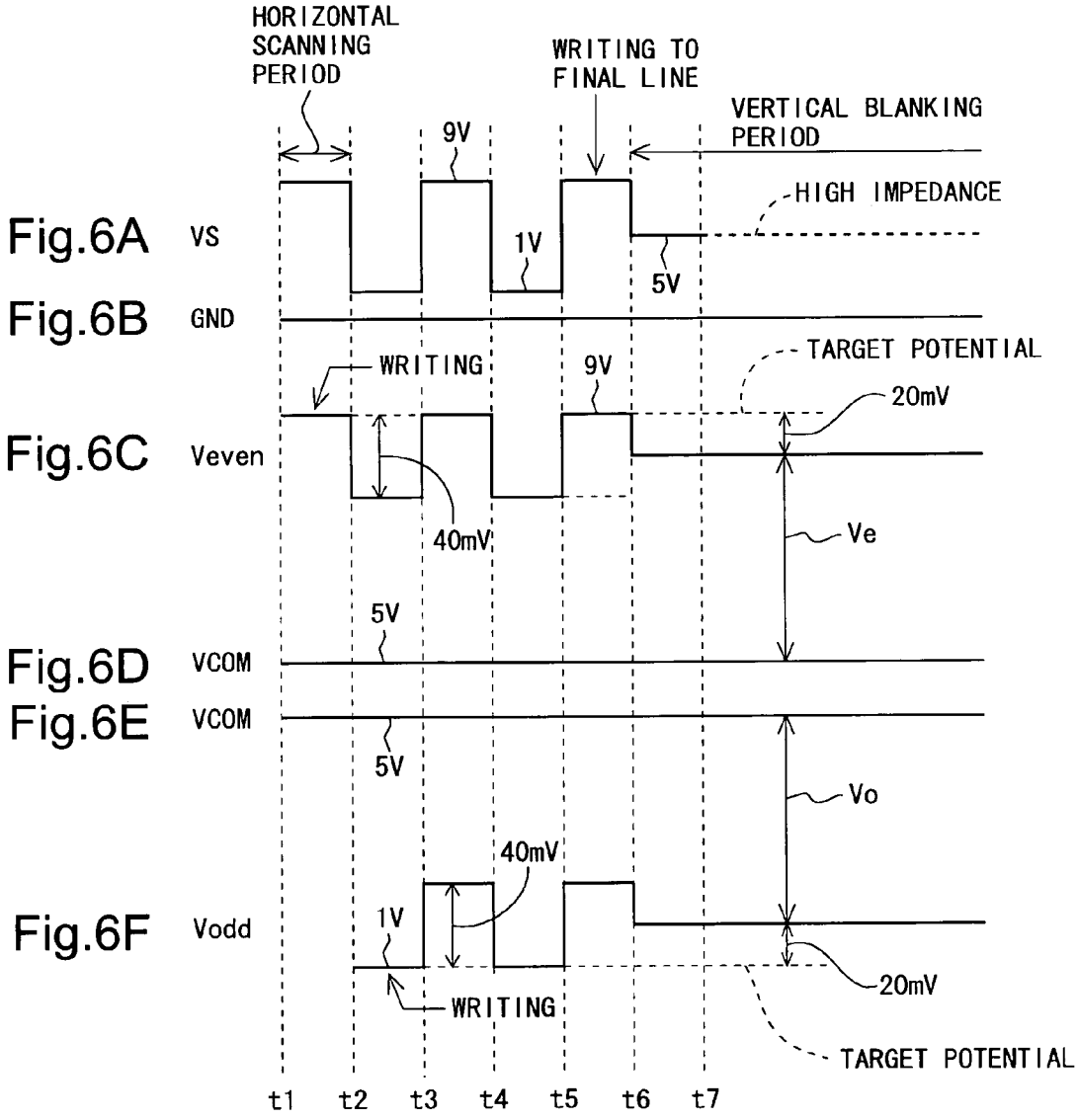
FIGS. 6A to 6F are signal waveform diagrams in an even-numbered frame showing a concrete example of values of voltages and potentials in the first embodiment.
Figure 16:
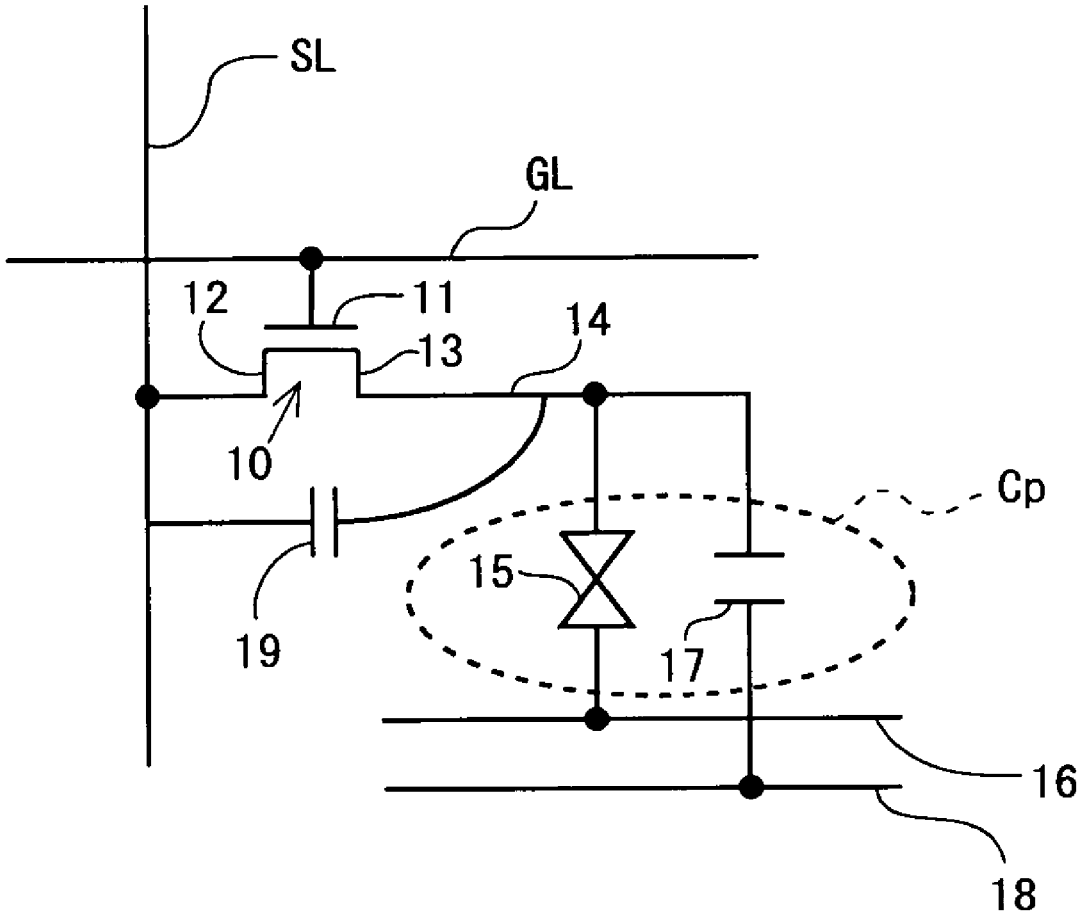
FIG. 16 is a circuit diagram showing the configuration of a pixel formation portion in an active matrix-type liquid crystal display device in a conventional technique.

FIG. 6 is a signal waveform diagram in an even-numbered frame showing a concrete example of values of voltages and potentials in the embodiment. As shown in FIG. 6A, during the period until the time point t6, potential of 9V and potential of 1V as the source potentials VS appear alternately every horizontal scanning period. Due to the changes in the source potential VS, as shown in FIGS. 6C and 6F, a change of 40 mV occurs every horizontal scanning period in each of the pixel potential Veven in an even-numbered line and the pixel potential Vodd in an odd-numbered line. At the time point t6 when writing to the final line as an even-numbered line ends, the source potential VS is set to 5V. The source potential VS is obtained by the following equation (1).

$$VS=9V-(9V-1V)/2 \quad (1)$$

As a result of the change in the source potential VS from 9V to 5V at the time point t6, the potential difference in an even-numbered line between the pixel potential Veven and the target potential becomes 20 mV, and the potential difference in an odd-numbered line between the pixel potential Vodd and the target potential also becomes 20 mV. Therefore, in the vertical blanking period, the voltage Ve applied to the liquid crystal in an even-numbered line and the voltage Vo applied to the liquid crystal in an odd-numbered line become almost equal to each other. Also in an odd-numbered frame, by operations similar to those in an even-numbered frame, in the vertical blanking period, the voltage Ve applied to the liquid crystal in an even-numbered line and the voltage Vo applied to the liquid crystal in an odd-numbered line become almost equal to each other.

1.6 Effects

As described above, in the embodiment, in the first horizontal scanning period in the vertical blanking period of each frame, the video signals for driving generated based on the vertical blanking period potential value DK calculated by the data value calculating unit 314 are applied to the source bus lines SL1 to SLn. The vertical blanking period potential value DK is calculated so that the magnitude of a change in the potential of the video signal for driving before and after a start point of the vertical blanking period becomes ½ of the change amount (amplitude) of the potential of the video signal for driving in the effective video period. Consequently, in the vertical blanking period, the potential difference in an even-numbered line between the pixel potential Veven and the target potential and the potential difference in an odd-numbered line between the pixel potential Vodd and the target pixel become almost equal to each other. As a result, in the vertical blanking period, the voltage applied to the liquid crystal in an even-numbered line and the voltage applied to the liquid crystal in an odd-numbered line become almost equal to each other, and occurrence of display unevenness caused by the difference between the application voltages can be suppressed. When the first horizontal scanning period in the vertical blanking period ends, the source bus lines SL1 to SLn are set to the high-impedance state. Therefore, in most of the vertical blanking period, supply of the video signals for driving to the source bus lines SL1 to SLn becomes unnecessary, and power consumption is reduced.

1.7 Modification

In the foregoing embodiment, the source potential VS is changed at the start time point of the vertical blanking period by ½ of the amplitude of the source potential VS in the effective video period. However, the present invention is not limited to the embodiment. In the vertical blanking period, as long as the potential difference in an even-numbered line between the pixel potential Veven and the target potential and the potential difference in an odd-numbered line between the pixel potential Vodd and the target potential become relatively close to each other, the magnitude of the change in the source potential VS at the start point of the vertical blanking period is not particularly limited. For example, in the case where potential of 9V and potential of 1V alternately appear as the source potential VS in the effective video period, also by setting the source potential VS to 6V at the start time point of the vertical blanking period as shown in FIG. 7, occurrence of display unevenness can be also suppressed.

In addition, irrespective of the value of the source potential VS in the effective video period, the video signals for driving of potential corresponding to a median value between the maximum and minimum values of the source potential VS which can be outputted from the source driver 300 may be applied to the source bus lines SL1 to SLn in the first horizontal scanning period in the vertical blanking period of each frame.

Further, in the foregoing embodiment, the value of the digital image signal DATA supplied to the first latch circuit 33 is controlled by the data processing circuit 31 shown in FIG. 3. However, the present invention is not limited to this. For example, it may be configured that by controlling the selection circuit 35 with the data processing circuit 31 voltages of a tone different from the tone indicated by the digital image signal DA sent from the display control circuit 200 are applied to the source bus lines SL1 to SLn.

Second Embodiment

2.1 General Configuration and the Like

In this embodiment, the general configuration, the configuration of the source driver 300, and the configuration of the data processing circuit 31 are similar to those of the first embodiment, so that their description will be omitted. However, in the embodiment, the data value calculating unit 314 in the data processing circuit 31 outputs a vertical blanking period potential value (hereinafter, referred to as a "first vertical blanking period potential value") DK1 for the first horizontal scanning period in the vertical blanking period and a vertical blanking period potential value (hereinafter, referred to as a "second vertical blanking period potential value") DK2 for the following horizontal scanning period frame by frame.

2.2 Driving Method

A driving method in the embodiment will be described with reference to FIGS. 8 and 9. FIG. 8 is a signal waveform diagram in an even-numbered frame as a first frame period. FIG. 9 is a signal waveform diagram in an odd-numbered frame as a second frame period. Note that it is assumed that preconditions such as the polarities of writing to lines are similar to those of the first embodiment.

First, attention is paid to an even-numbered frame. In a period until the time point t6 when the vertical blanking period starts (effective video period), operations similar to those of the first embodiment shown in FIG. 1 are performed. Therefore, just before the time point t6 when writing to the final line as an even-numbered line is finished, although the pixel potential Veven of an even-numbered line is equal to the target potential, the pixel potential Vodd of an odd-numbered line is higher than the target potential by ΔV.

At time point t6, the source potential VS drops by V2 as shown in FIG. 8A. The dropped potential is maintained only in one horizontal scanning period. At time point t7 or later, the source bus lines SL1 to SLn are in the high-impedance state. Note that the value of the source potential VS in the horizontal scanning period from the time point t6 to the time point t7 is a value based on the first vertical blanking period potential value DK1.

As a result of the drop of the source potential VS at the time point t6 as described above, as shown in FIGS. 8C and 8F, both of the pixel potential Veven of an even-numbered line and the pixel potential Vodd of an odd-numbered line drop by ΔVa at the time point t6. Note that ΔVa is obtained by the following equation (2).

$$\Delta Va=(V2\times\Delta V)/V1 \quad (2)$$

where V1 is a change amount (amplitude) of the source potential in the effective video period, V2 is a change amount of the source potential VS at time point t6, and ΔV is a change amount of the pixel potentials Veven and Vodd in the effective video period.

Accordingly, immediately after the time point t6, the potential difference in an even-numbered line between the pixel potential Veven and the target potential is ΔVa. On the other hand, the potential difference in an odd-numbered line between the pixel potential Vodd and the target potential is the difference between ΔV and ΔVa, that is, ΔVb shown in FIG. 8F. At time point t7 or later, the source bus lines SL1 to SLn are in the high-impedance state, so that the pixel potential Veven in an even-numbered line and the pixel potential Vodd in an odd-numbered line are maintained as they are. As a result, in the vertical blanking period of the even-numbered frame, the voltage Ve applied to the liquid crystal in the even-numbered line is smaller than the voltage Vo applied to the liquid crystal in an odd-numbered line by the difference between ΔVa and ΔVb. Note that as described above, in an even-numbered frame, the period from the time point t6 to the time point t7 is a transition period.

Next, attention is paid to an odd-numbered frame. In a period until the time point t6 when the vertical blanking period starts, operations similar to those of the first embodiment shown in FIG. 5 are performed. Therefore, just before the time point t6 when writing to the final line as an even-numbered line is finished, although the pixel potential Veven of an even-numbered line is equal to the target potential, the pixel potential Vodd of an odd-numbered line is lower than the target potential by ΔV.

At time point t6, the source potential VS rises by V2 described above. Accordingly, both of the pixel potential Veven in an even-numbered line and the pixel potential Vodd in an odd-numbered line rise by ΔVa at the time point t6. In the horizontal scanning period from the time point t6 to the time point t7, the source potential VS is maintained as it is. Consequently, in the horizontal scanning period from the time point t6 to the time point t7, the potential difference in an even-numbered line between the pixel potential Veven and the target potential becomes ΔVa, and the potential difference in an odd-numbered line between the pixel potential Vodd and the target potential becomes ΔVb. Note that the value of the source potential VS in the horizontal scanning period from the time point t6 to the time point t7 is a value based on the first vertical blanking period potential value DK1 described above.

At time point t7, the source potential VS is set to a potential lower than the potential on the high potential side in the effective video period by V2 described above. Consequently, According to the change amount of the source potential VS, the pixel potential Veven in an even-numbered line and the pixel potential Vodd in an odd-numbered line decrease. As a result, immediately after the time point t7, the potential difference in an even-numbered line between the pixel potential Veven and the target potential becomes ΔVb. On the other hand, the potential difference in an odd-numbered line between the pixel potential Vodd and the target potential becomes ΔVa. Note that the value of the source potential VS in the horizontal scanning period from the time point t7 to the time point t8 is a value based on the second vertical blanking period potential value DK2 described above.

At time point t8 or later, the source bus lines SL1 to SLn are in the high-impedance state, so that the pixel potential Veven in an even-numbered line and the pixel potential Vodd in an odd-numbered line are maintained as they are. As a result, in the vertical blanking period of an odd-numbered frame, the voltage Ve applied to the liquid crystal in an even-numbered line becomes larger than the voltage Vo applied to the liquid crystal in an odd-numbered line by the difference between ΔVa and ΔVb. Note that as described above, in an odd-numbered frame, the period from the time point t6 to the time point t8 is a transition period.

As described above, in the vertical blanking period in an even-numbered frame, the voltage Ve applied to the liquid crystal in an even-numbered line becomes smaller than the voltage Vo applied to the liquid crystal in an odd-numbered line by the difference between ΔVa and ΔVb. On the other hand, in the vertical blanking period in an odd-numbered frame, the voltage Ve applied to the liquid crystal in an even-numbered line becomes larger than the voltage Vo applied to the liquid crystal in an odd-numbered line by the difference between ΔVa and ΔVb.

Note that in a liquid crystal display device for performing display in a normally black mode, the source potential VS in the horizontal scanning period from the time point t6 to the time point t7 in the even-numbered frame and the horizontal scanning period from the time point t7 to the time point t8 in the odd-numbered frame may be set to a potential for displaying black. Moreover, in a liquid crystal display device for performing display in a normally white mode, the source potential VS in the horizontal scanning period from the time point t6 to the time point t7 in the even-numbered frame and the horizontal scanning period from the time point t7 to the time point t8 in the odd-numbered frame may be set to a potential for displaying white.

2.3 Example

Next, a concrete example of values of voltages and potentials in the embodiment will be described. FIG. 10 is a signal waveform diagram in an even-numbered frame. As shown in FIG. 10A, during the period until the time point t6, potential of 9V and potential of 1V as the source potentials VS appear alternately every horizontal scanning period. Due to the changes in the source potential VS, as shown in FIGS. 10C and 10F, a change of 40 mV occurs every horizontal scanning period in each of the pixel potential Veven in an even-numbered line and the pixel potential Vodd in an odd-numbered line. At the time point t6 when writing to the final line as an even-numbered line ends, the source potential VS is set to 4V.

As a result of the change in the source potential VS from 9V to 4V at the time point t6, the potential difference in an even-numbered line between the pixel potential Veven and the target potential becomes 25 mV, and the potential difference in an odd-numbered line between the pixel potential Vodd and the target potential becomes 15 mV. Therefore, in the vertical blanking period of an even-numbered frame, the voltage Ve applied to the liquid crystal in an even-numbered line becomes smaller than the voltage Vo applied to the liquid crystal in an odd-numbered line by 10 mV.

FIG. 11 is a signal waveform diagram in an odd-numbered frame. As shown in FIG. 11A, during the period until the time point t6, potential of 9V and potential of 1V as the source potentials VS appear alternately every horizontal scanning period. At the time point t6 when writing to the final line as an even-numbered line ends, the source potential VS is set to 6V.

As a result of the change in the source potential VS from 9V to 6V at the time point t6, the potential difference in an even-numbered line between the pixel potential Veven and the target potential becomes 25 mV, and the potential difference in an odd-numbered line between the pixel potential Vodd and the target potential becomes 15 mV. Further, at time point t7, the source potential VS is set to 4V. Consequently, the potential difference in an even-numbered line between the pixel electrode Veven and the target potential becomes 15 mV, and the potential difference in an odd-numbered line between the pixel potential Vodd and the target potential becomes 25 mV. At time point t8 or later, the source bus lines SL1 to SLn are set to the high-impedance state, so that the pixel potential Veven in an even-numbered line and the pixel potential Vodd in an odd-numbered line are maintained as they are. As a result, in the vertical blanking period of an odd-numbered frame, the voltage Ve applied to the liquid crystal in an even-numbered line becomes larger than the voltage Vo applied to the liquid crystal in an odd-numbered line by 10 mV.

As described above, in the vertical blanking period of an even-numbered frame, the voltage Ve applied to the liquid crystal in an even-numbered line becomes smaller than the voltage Vo applied to the liquid crystal in an odd-numbered line by 10 mV. On the other hand, in the vertical blanking period of an odd-numbered frame, the voltage Ve applied to the liquid crystal in an even-numbered line becomes larger than the voltage Vo applied to the liquid crystal in an odd-numbered line by 10 mV.

2.4 Effects

As described above, in the embodiment, in the first horizontal scanning period in the vertical blanking period of each frame, the video signals for driving generated based on the first vertical blanking period potential value DK1 calculated by the data value calculating unit 314 are applied to the source bus lines SL1 to SLn. Moreover, in the second horizontal scanning period in the vertical blanking period of an odd-numbered frame, the video signals for driving generated based on the second vertical blanking period potential value DK2 calculated by the data value calculating unit 314 are applied to the source bus lines SL1 to SLn. Here, the first vertical blanking period potential value DK1 in an even-numbered frame and the second vertical blanking period potential value DK2 in an odd-numbered frame are equal to each other. Consequently, a value obtained by subtracting the voltage Vo applied to the liquid crystal in the odd-numbered line from the voltage Ve applied to the liquid crystal in the even-numbered line in the vertical blanking period in the even-numbered frame and a value obtained by subtracting the voltage Ve applied to the liquid crystal in the even-numbered line from the voltage Vo applied to the liquid crystal in the odd-numbered line in the vertical blanking period of the odd-numbered frame are almost equal to each other. Consequently, using successive two frame periods as one unit, in the vertical blanking period, an average voltage applied to the liquid crystal in an even-numbered line and an average voltage applied to the liquid crystal in an odd-numbered line become almost equal to each other. Therefore, occurrence of display unevenness caused by the difference between the application voltages is suppressed.

3. Third Embodiment 3.1 General Configuration and the Like

In this embodiment, the general configuration, the configuration of the source driver 300, and the configuration of the data processing circuit 31 are similar to those of the second embodiment, so that their description will be omitted. However, in the embodiment, the polarity of common electrode potential VCOM is inverted every horizontal scanning period.

3.2 Driving Method

A driving method in the embodiment will be described with reference to FIGS. 12 and 13. FIG. 12 is a signal waveform diagram in an even-numbered frame as a first frame period. FIG. 13 is a signal waveform diagram in an odd-numbered frame as a second frame period. Note that it is assumed that preconditions such as the polarities of writing to lines are similar to those of the first and second embodiments.

First, attention is paid to an even-numbered frame. As shown in FIGS. 12A to 12C, in a period from time point t1 to time point t6, high potential and low potential appear alternately every horizontal scanning period with respect to the source potential VS, and low potential and high potential appear alternately every horizontal scanning period with respect to the common electrode potential VCOM. Here, when inverting the polarity of the common electrode potential VCOM, the source bus line SL is set to the high-impedance state (the same holds for an odd-numbered frame). Consequently, changes in the pixel potentials Veven and Vodd are based on a change in the common electrode potential VCOM and a change in the source potential VS. Consequently, as shown in FIG. 12D, after the horizontal scanning period in which writing is performed, the pixel potential Veven in an even-numbered line becomes lower than the target potential by ΔV in the horizontal scanning period in which writing to an odd-numbered line is performed, and the potential returns to the target potential in the next horizontal scanning period, that is, a horizontal scanning period in which writing to an even-numbered line is performed. On the other hand, as shown in FIG. 12E, after the horizontal scanning period in which writing is performed, the pixel potential Vodd in an odd-numbered line becomes higher than the target potential by ΔV in the horizontal scanning period in which writing to an even-numbered line is performed, and the potential returns to the target potential in the next horizontal scanning period, that is, a horizontal scanning period in which writing to an odd-numbered line is performed. As a result, just before the time point t6 when writing to the final line as an even-numbered line is finished, although the pixel potential Veven of an even-numbered line is equal to the target potential, the pixel potential Vodd of an odd-numbered line is higher than the target potential by ΔV.

At time point t6, the polarity is inverted from the low potential to the high potential with respect to the common electrode potential VCOM, while the potential is maintained as it is with respect to the source potential VS. When the common electrode potential VCOM immediately after the time point t6 is set to the high potential, the source potential VS is thus set to the maximum potential in the effective video period. As a result, in the horizontal scanning period from time point t6 to time point t7, the pixel potential Veven in an even-numbered line is lower than the target potential by ΔVa, and the pixel potential Vodd in an odd-numbered line is higher than the target potential by ΔVb. At time point t7 or later, the source bus lines SL1 to SLn are in the high-impedance state. Accordingly, in the vertical blanking period of an even-numbered frame, the voltage applied to the liquid crystal in the even-numbered line is smaller than the voltage applied to the liquid crystal in an odd-numbered line by the difference between ΔVa and ΔVb. Note that the value of the source potential VS in the horizontal scanning period from the time point t6 to the time point t7 is based on the first vertical blanking period potential value DK1 described above.

Next, attention is paid to an odd-numbered frame. As shown in FIGS. 13A to 13C, during the period from time point t1 to time point t6, low potential and high potential appear alternately every horizontal scanning period with respect to the source potential VS, and high potential and low potential appear alternately every horizontal scanning period with respect to the common electrode potential VCOM. Accordingly, as shown in FIG. 13D, after the horizontal scanning period in which writing is performed, the pixel potential Veven in an even-numbered line becomes higher than the target potential by ΔV in the horizontal scanning period in which writing to an odd-numbered line is performed. In the next horizontal scanning period, that is, a horizontal scanning period in which writing to an even-numbered line is performed, the potential returns to the target potential. On the other hand, as shown in FIG. 13E, after the horizontal scanning period in which writing is performed, the pixel potential Vodd in an odd-numbered line becomes lower than the target potential by ΔV in the horizontal scanning period in which writing to an even-numbered line is performed. In the next horizontal scanning period, that is, a horizontal scanning period in which writing to an odd-numbered line is performed, the potential returns to the target potential. As a result, just before the time point t6 when writing to the final line as an even-numbered line is finished, although the pixel potential Veven in an even-numbered line becomes the target potential, the pixel potential Vodd in an odd-numbered line is lower than the target potential by ΔV.

At time point t6, the polarity is inverted from the high potential to the low potential with respect to the common electrode potential VCOM, while the potential is maintained as it is with respect to the source potential VS. Consequently, in the horizontal scanning period from the time point t6 to the time point t7, the pixel potential Veven in an even-numbered line is higher than the target potential by ΔVa, and the pixel potential Vodd in an odd-numbered line is lower than the target potential by ΔVb.

Further, at time point t7, the polarity is inverted from the low potential to the high potential with respect to the common electrode potential VCOM, and the polarity is also inverted from the low potential to the high potential with respect to the source potential VS. In such a manner, the source potential VS is set to the maximum potential in the effective video period. Accordingly, in the horizontal scanning period from time point t7 to time point t8, the pixel potential Veven in an even-numbered line becomes higher than the target potential by ΔVb, and the pixel potential Vodd in an odd-numbered line becomes lower than the target potential by ΔVa. Note that the value of the source potential VS in the horizontal scanning period from time point t7 to time point t8 is based on the second vertical blanking period potential value DK2 described above.

At time point t8 or later, the source bus lines SL1 to SLn are set to the high-impedance state. Accordingly, in the vertical blanking period of an odd-numbered frame, the voltage applied to the liquid crystal in the even-numbered line becomes larger than the voltage applied to the liquid crystal in an odd-numbered line by the difference between ΔVa and ΔVb.

As described above, in the vertical blanking period of an even-numbered frame, the voltage applied to the liquid crystal in an even-numbered line becomes smaller than the voltage applied to the liquid crystal in an odd-numbered line by the difference between ΔVa and ΔVb. On the other hand, in the vertical blanking period of an odd-numbered frame, the voltage applied to the liquid crystal in an even-numbered line becomes larger than the voltage applied to the liquid crystal in an odd-numbered line by the difference between ΔVa and ΔVb.

Note that in the case where the common electrode potential VCOM immediately after the time point t6 in an even-numbered frame is set to be low potential, it is sufficient to set the source potential VS to be low potential in the horizontal scanning period from the time point t6 to the time point t7 in the even-numbered frame, and to set the source potential VS to be low potential also in the horizontal scanning period from the time point t7 to the time point t8 of an odd-numbered frame.

Moreover, in a liquid crystal display device for performing display in a normally black mode, the source potential VS in the horizontal scanning period from the time point t6 to the time point t7 in the even-numbered frame and the horizontal scanning period from the time point t7 to the time point t8 in the odd-numbered frame may be set to the potential for displaying black. Further, in a liquid crystal display device for performing display in a normally white mode, the source potential VS in the horizontal scanning period from the time point t6 to the time point t7 in the even-numbered frame and the horizontal scanning period from the time point t7 to the time point t8 in the odd-numbered frame may be set to the potential for displaying white.

3.3 Example

Next, a concrete example of values of voltages and potentials in the embodiment will be described. FIG. 14 is a signal waveform diagram in an even-numbered frame. As shown in FIGS. 14A to 14C, during the period until the time point t6, potential of 4V and potential of 1V appear alternately every horizontal scanning period with respect to the source potentials VS, and potential of 0V and potential of 5V appear alternately every horizontal scanning period with respect to the common electrode potential VCOM. Due to these changes in the source potential VS and the common electrode potential VCOM, as shown in FIGS. 14D and 14E, in the horizontal scanning period in which writing to an even-numbered line is performed, a potential difference of 40 mV occurs between the pixel potential Vodd in an odd-numbered line and the target potential. In the horizontal scanning period in which writing to an odd-numbered line is performed, the potential difference of 40 mV occurs between the pixel potential Veven in an even-numbered line and the target potential.

In the horizontal scanning period from the time point t5 to the time point t6, the source potential VS is 4V. At time point t6, the common electrode potential VCOM rises from 0V to 5V. On the other hand, the source potential VS is maintained at 4V also in the horizontal scanning period from the time point t6 to the time point t7. As a result, in the horizontal scanning period from the time point t6 to the time point t7, the potential difference in an even-numbered line between the pixel potential Veven and the target potential becomes 25 mV, and the potential difference in an odd-numbered line between the pixel potential Vodd and the target potential becomes 15 mV.

At time point t7 or later, the source bus lines SL1 to SLn are set to the high-impedance state. Consequently, in the vertical blanking period of an even-numbered frame, the voltage applied to the liquid crystal in an even-numbered line becomes smaller than the voltage applied to the liquid crystal in an odd-numbered line by 10 mV.

FIG. 15 is a signal waveform diagram in an odd-numbered frame. As shown in FIGS. 15A to 15C, during the period until the time point t6, potential of 1V and potential of 4V appear alternately every horizontal scanning period with respect to the source potentials VS, and potential of 5V and potential of 0V appear alternately every horizontal scanning period with respect to the common electrode potential VCOM. Here, in the horizontal scanning period from the time point t5 to the time point t6, the source potential VS is 1V. At the time point t6, the common electrode potential VCOM drops from 5V to 0V. On the other hand, the source potential VS is maintained at 1V also in the horizontal scanning period from the time point t6 to the time point t7. As a result, in the horizontal scanning period from the time point t6 to the time point t7, the potential difference between the pixel potential Veven in an even-numbered line and the target potential becomes 25 mV, and the potential difference between the pixel potential Vodd in an odd-numbered line and the target potential becomes 15 mV.

At the time point t7, the common electrode potential VCOM rises from 0V to 5V, and the source potential VS rises from 1V to 4V. Consequently, in the horizontal scanning period from the time point t7 to the time point t8, the pixel potential Veven in an even-numbered line becomes higher than the target potential by 15 mV, and the pixel potential Vodd in an odd-numbered line becomes lower than the target potential by 25 mV.

At the time point t8 or later, the source bus lines SL1 to SLn are set to a high-impedance state. Consequently, in the vertical blanking period of an odd-numbered frame, the voltage applied to the liquid crystal in an even-numbered line becomes larger than the voltage applied to the liquid crystal in an odd-numbered line by 10 mV.

As described above, in the vertical blanking period of an even-numbered frame, the voltage applied to the liquid crystal in an even-numbered line becomes smaller than the voltage applied to the liquid crystal in an odd-numbered line by 10 mV. In the vertical blanking period of an odd-numbered frame, the voltage applied to the liquid crystal in an even-numbered line becomes larger than the voltage applied to the liquid crystal in an odd-numbered line by 10 mV.

3.4 Effects

As described above, in the embodiment, the common electrode inverting drive is performed, however, in a manner similar to the second embodiment, a value obtained by subtracting the voltage applied to the liquid crystal in an odd-numbered line from the voltage applied to the liquid crystal in an even-numbered line in the vertical blanking period in an even-numbered frame and a value obtained by subtracting the voltage applied to the liquid crystal in an even-numbered line from the voltage applied to the liquid crystal in an odd-numbered line in the vertical blanking period of an odd-numbered frame are almost equal to each other. Consequently, also in the case where there is restriction in potential of a video signal for driving which can be outputted from the source driver 300, using successive two frame periods as one unit, in the vertical blanking period, an average voltage applied to the liquid crystal in an even-numbered line and an average voltage applied to the liquid crystal in an odd-numbered line become almost equal to each other. As a result, in a display device in which the common electrode inverting drive is performed, occurrence of display unevenness caused by the difference between the application voltages is suppressed.

4. Others

In each of the foregoing embodiments, the data processing circuit 31 for determining the potential value of the video signal for driving in the first and second horizontal scanning periods in the vertical blanking period (the vertical blanking period potential value) is provided for the source driver 300. However, the invention is not limited to the configuration. For example, the data processing circuit 31 may be provided for the display control circuit 200. Moreover, the configuration for determining the vertical blanking period potential value is not limited to that of the data processing circuit 31 in the foregoing embodiments.

The invention claimed is:

1. An active matrix-type display device comprising:

a plurality of video signal lines for transmitting a video signal based on an image to be displayed;

a plurality of scanning signal lines crossing the plurality of video signal lines;

a plurality of switch elements disposed in a matrix respectively in correspondence with intersections of the plurality of video signal lines and the plurality of scanning signal lines;

a plurality of pixel electrodes respectively connected to the plurality of switch elements;

a common electrode commonly provided for the plurality of pixel electrodes;

a video signal line driving circuit for applying the video signal to the plurality of video signal lines so that polarity of potential of the plurality of pixel electrodes for the potential of the common electrode is inverted every first number of horizontal scanning periods; and a transition period video signal potential determining unit for determining a potential of a video signal to be applied to the plurality of video signal lines in a transition period in a frame period made of an effective video period and a vertical blanking period and in which displaying an image of one frame is performed, the transition period being a length of a horizontal scanning period and a period in which a time is passed from start time point of the vertical blanking period, wherein from an end time point of the transition period in a preceding frame period of two successive frame periods to a start point of the effective video period in a subsequent frame period, the video signal line driving circuit and the plurality of video signal lines are electrically separated from each other.

2. The display device according to claim 1, wherein the transition period video signal potential determining unit is configured to determine potential of a video signal to be applied to the plurality of video signal lines in the transition period based on a change in potential of a video signal in the effective video period.

3. The display device according to claim 2, wherein the transition period video signal potential determining unit is configured to determine potential of a video signal to be applied to the plurality of video signal lines in the transition period so that a change in potential between video signals before and after the start point of the vertical blanking period becomes the half of a change in potential of a video signal in the effective video period.

4. The display device according to claim 1, wherein the transition period video signal potential determining unit is configured to determine to set potential of a video signal to be applied to the plurality of video signal lines in the transition period to a median potential of maximum and minimum potentials of video signals which is applied from the video signal line driving circuit to the plurality of video signal lines.

5. The display device according to claim 1, wherein the transition period video signal potential determining unit is configured to determine potential of a video signal to be applied to the plurality of video signal lines in the transition period so that, in first and second frame periods as successive two frame periods, a potential of a video signal at the end time point of the transition period in the first frame period and a potential of a video signal at the end time point of the transition period in the second frame period become almost equal to each other.

6. The display device according to claim 5, wherein when the display device performs display in a normally black mode, the transition period video signal potential determining unit is configured to determine potential of a video signal to be applied to the plurality of video signal lines in the transition period so that potential of a video signal at the end time point of the transition period in the first frame period becomes potential for displaying black, and potential of a video signal at the end time point of the transition period in the second frame period becomes potential for displaying black.

7. The display device according to claim 5, the display device performing display in a normally white mode, wherein the transition period video signal potential determining unit is configured to determine potential of a video signal to be applied to the plurality of video signal lines in the transition period so that potential of a video signal at the end time point of the transition period in the first frame period becomes potential for displaying white, and potential of a video signal at the end time point of the transition period in the second frame period becomes potential for displaying white.

8. The display device according to claim 1, wherein polarity of potential of the plurality of pixel electrodes with respect to potential of the common electrode is inverted every one horizontal scanning period.

9. The display device according to claim 1, wherein when the display device performs display in a normally black mode, the transition period video signal potential determining unit determines potential of a video signal to be applied to the plurality of video signal lines in the transition period so that potential of a video signal at the end time point of the transition period becomes potential for displaying black.

10. The display device according to claim 1, wherein when the display device performs display in a normally white mode, the transition period video signal potential determining unit determines potential of a video signal to be applied to the plurality of video signal lines in the transition period so that potential of a video signal at the end time point of the transition period becomes potential for displaying white.

11. An active matrix-type display device comprising:

a plurality of video signal lines for transmitting a video signal based on an image to be displayed;

a plurality of scanning signal lines crossing the plurality of video signal lines;

a plurality of switch elements disposed in a matrix respectively in correspondence with intersections of the plurality of video signal lines and the plurality of scanning signal lines;

a plurality of pixel electrodes respectively connected to the plurality of switch elements;

a common electrode commonly provided for the plurality of pixel electrodes;

a video signal line driving circuit for applying the video signal to the plurality of video signal lines so that polarity of potential of the plurality of pixel electrodes for the potential of the common electrode is inverted every first number of horizontal scanning periods; and a transition period video signal potential determining unit for determining potential of a video signal to be applied to the plurality of video signal lines in a transition period in a frame period made of an effective video period and a vertical blanking period and in which displaying an image of one frame is performed, the transition period being a period in which a time is passed from a start time point of the vertical blanking period, wherein the transition period video signal potential determining unit is configured to determine potential of a video signal to be applied to the plurality of video signal lines in the transition period so that, in first and second frame periods as successive two frame periods, a potential of a video signal at the end time point of the transition period in the first frame period and a potential of a video signal at the end time point of the transition period in the second frame period become almost equal to each other and potential of the common electrode is set to be high potential and low potential alternately every first number of horizontal scanning periods, length of the transition period in the first frame period and length of the transition period in the second frame period are set to be different from each other, and the transition period video signal potential determining unit determines potential of a video signal to be applied to the plurality of video signal lines in the transition period so that, when potential of the common electrode is set as high potential immediately after start of the transition period in the first frame period, potential of the video signal at the end time point of the transition period in the first frame period becomes equal to maximum potential of the video signal in the effective video period and potential of the video signal at the end time point of the transition period in the second frame period becomes equal to maximum potential of the video signal in the effective video period, and determine potential of a video signal to be applied to the plurality of video signal lines in the transition period so that, when potential of the common electrode is set as low potential immediately after start of the transition period in the first frame period, potential of the video signal at the end time point of the transition period in the first frame period becomes equal to minimum potential of the video signal in the effective video period and potential of the video signal at the end time point of the transition period in the second frame period becomes equal to minimum potential of the video signal in the effective video period.

12. The display device according to claim 11, wherein length of the transition period in the first frame period is set to be equal to length of the first number of horizontal scanning periods as an interval in which polarity of potential of the plurality of pixel electrodes with respect to potential of the common electrode is inverted, and length of the transition period in the second frame period is set to length which is twice as long as the length of the transition period in the first frame period.

13. A driving circuit of an active matrix-type display device including a plurality of video signal lines for transmitting a video signal based on an image to be displayed, a plurality of scanning signal lines crossing the plurality of video signal lines, a plurality of switch elements disposed in a matrix respectively in correspondence with intersections of the plurality of video signal lines and the plurality of scanning signal lines, a plurality of pixel electrodes respectively connected to the plurality of switch elements, and a common electrode commonly provided for the plurality of pixel electrodes, the driving circuit comprising:

a video signal line driving circuit for applying the video signal to the plurality of video signal lines so that polarity of potential of the plurality of pixel electrodes for the potential of the common electrode is inverted every first number of horizontal scanning periods; and a transition period video signal potential determining unit provided on the inside or outside of the video signal line driving circuit and determining potential of a video signal to be applied to the plurality of video signal lines in a transition period in a frame period made of an effective video period and a vertical blanking period and in which displaying an image of one frame is performed, the transition period being a length of a horizontal scanning period and a period in which a time is passed from start time point of the vertical blanking period, wherein from an end time point of the transition period in a preceding frame period of two successive frame periods to a start point of the effective video period in a subsequent frame period, the video signal line driving circuit and the plurality of video signal lines are electrically separated from each other.

14. The driving circuit according to claim 13, wherein the transition period video signal potential determining unit is configured to determine potential of a video signal to be applied to the plurality of video signal lines in the transition period based on a change in potential of a video signal in the effective video period.

15. The driving circuit according to claim 14, wherein the transition period video signal potential determining unit is configured to determine potential of a video signal to be applied to the plurality of video signal lines in the transition period so that a change in potential between video signals before and after the start point of the vertical blanking period becomes the half of a change in potential of a video signal in the effective video period.

16. The driving circuit according to claim 13, wherein the transition period video signal potential determining unit is configured to determine to set potential of a video signal to be applied to the plurality of video signal lines in the transition period to a median potential of maximum and minimum potentials of video signals which is applied from the video signal line driving circuit to the plurality of video signal lines.

17. The driving circuit according to claim 13, wherein the transition period video signal potential determining unit is configured to determine potential of a video signal to be applied to the plurality of video signal lines in the transition period so that, in first and second frame periods as successive two frame periods, a potential of a video signal at the end time point of the transition period in the first frame period and a potential of a video signal at the end time point of the transition period in the second frame period become almost equal to each other.

18. A driving circuit of an active matrix-type display device including a plurality of video signal lines for transmitting a video signal based on an image to be displayed, a plurality of scanning signal lines crossing the plurality of video signal lines, a plurality of switch elements disposed in a matrix respectively in correspondence with intersections of the plurality of video signal lines and the plurality of scanning signal lines, a plurality of pixel electrodes respectively connected to the plurality of switch elements, and a common electrode commonly provided for the plurality of pixel electrodes, the driving circuit comprising:

a video signal line driving circuit for applying the video signal to the plurality of video signal lines so that polarity of potential of the plurality of pixel electrodes for the potential of the common electrode is inverted every number of horizontal scanning periods; and a transition period video signal potential determining unit provided on the inside or outside of the video signal line driving circuit and determining potential of a video signal to be applied to the plurality of video signal lines in a transition period in a frame period made of an effective video period and a vertical blanking period and in which displaying an image of one frame is performed, the transition period being a period in which a time is passed from start time point of the vertical blanking period, wherein the transition period video signal potential determining unit is configured to determine potential of a video signal to be applied to the plurality of video signal lines in the transition period so that, in first and second frame periods as successive two frame periods, a potential of a video signal at the end time point of the transition period in the first frame period and a potential of a video signal at the end time point of the transition period in the second frame period become almost equal to each other and potential of the common electrode is set to be high potential and low potential alternately every first number of horizontal scanning periods, length of the transition period in the first frame period and length of the transition period in the second frame period are set to be different from each other, and the transition period video signal potential determining unit is configured to determine potential of a video signal to be applied to the plurality of video signal lines in the transition period so that, when potential of the common electrode is set as high potential immediately after start of the transition period in the first frame period, potential of the video signal at the end time point of the transition period in the first frame period becomes equal to maximum potential of the video signal in the effective video period and potential of the video signal at the end time point of the transition period in the second frame period becomes equal to maximum potential of the video signal in the effective video period, and determine potential of a video signal to be applied to the plurality of video signal lines in the transition period so that, when potential of the common electrode is set as low potential immediately after start of the transition period in the first frame period, potential of the video signal at the end time point of the transition period in the first frame period becomes equal to minimum potential of the video signal in the effective video period and potential of the video signal at the end time point of the transition period in the second frame period becomes equal to minimum potential of the video signal in the effective video period.

19. The driving circuit according to claim 18, wherein length of the transition period in the first frame period is set to be equal to length of the first number of horizontal scanning periods as an interval in which polarity of potential of the plurality of pixel electrodes with respect to potential of the common electrode is inverted, and length of the transition period in the second frame period is set to length which is twice as long as the length of the transition period in the first frame period.

20. A driving method of an active matrix-type display device including a plurality of video signal lines for transmitting a video signal based on an image to be displayed, a plurality of scanning signal lines crossing the plurality of video signal lines, a plurality of switch elements disposed in a matrix respectively in correspondence with intersections of the plurality of video signal lines and the plurality of scanning signal lines, a plurality of pixel electrodes respectively connected to the plurality of switch elements, and a common electrode commonly provided for the plurality of pixel electrodes, the method comprising:

a video signal line driving step of applying the video signal to the plurality of video signal lines so that polarity of potential of the plurality of pixel electrodes for the potential of the common electrode is inverted every first number of horizontal scanning periods;

a transition period video signal potential determining step of determining potential of a video signal to be applied to the plurality of video signal lines in a transition period in a frame period made of an effective video period and a vertical blanking period and in which displaying an image of one frame is performed, the transition period being a length of a horizontal scanning period and a period in which a time is passed from start time point of the vertical blanking period; and electrically separating the video signal line driving circuit and the plurality of video signal lines from an end time point of the transition period in a preceding frame period of two successive frame periods to start point of the effective video period in subsequent frame period.

21. The driving method according to claim 20, wherein in the transition period video signal potential determining step, potential of a video signal to be applied to the plurality of video signal lines in the transition period is determined based on a change in potential of a video signal in the effective video period.

22. The driving method according to claim 21, wherein in the transition period video signal potential determining step, potential of a video signal to be applied to the plurality of video signal lines in the transition period is determined so that a change in potential between video signals before and after the start point of the vertical blanking period becomes the half of a change in potential of a video signal in the effective video period.

23. The driving method according to claim 20, wherein in the transition period video signal potential determining step, a median potential of maximum and minimum potentials of video signals which is applied from the video signal line driving circuit to the plurality of video signal lines is determined as potential of a video signal to be applied to the plurality of video signal lines in the transition period.

24. The driving method according to claim 20, wherein in the transition period video signal potential determining step, potential of a video signal to be applied to the plurality of video signal lines in the transition period is determined so that, in first and second frame periods as successive two frame periods, a potential of a video signal at the end time point of the transition period in the first frame period and a potential of a video signal at the end time point of the transition period in the second frame period become almost equal to each other.

25. A driving method of an active matrix-type display device including a plurality of video signal lines for transmitting a video signal based on an image to be displayed, a plurality of scanning signal lines crossing the plurality of video signal lines, a plurality of switch elements disposed in a matrix respectively in correspondence with intersections of the plurality of video signal lines and the plurality of scanning signal lines, a plurality of pixel electrodes respectively connected to the plurality of switch elements, and a common electrode commonly provided for the plurality of pixel electrodes, the method comprising:

a video signal line driving step of applying the video signal to the plurality of video signal lines so that polarity of potential of the plurality of pixel electrodes for the potential of the common electrode is inverted every number of horizontal scanning periods;

a transition period video signal potential determining step of determining potential of a video signal to be applied to the plurality of video signal lines in a transition period in a frame period made of an effective video period and a vertical blanking period and in which displaying an image of one frame is performed, the transition period being a period in which a time is passed from start time point of the vertical blanking period, wherein in the transition period video signal potential determining step, potential of a video signal to be applied to the plurality of video signal lines in the transition period is determined so that, in first and second frame periods as successive two frame periods, a potential of a video signal at the end time point of the transition period in the first frame period and a potential of a video signal at the end time point of the transition period in the second frame period become almost equal to each other and potential of the common electrode is set to be high potential and low potential alternately every first number of horizontal scanning periods, length of the transition period in the first frame period and length of the transition period in the second frame period are set to be different from each other, and in the transition period video signal potential determining step, potential of a video signal to be applied to the plurality of video signal lines in the transition period is determined so that, when potential of the common electrode is set as high potential immediately after start of the transition period in the first frame period, potential of the video signal at the end time point of the transition period in the first frame period becomes equal to maximum potential of the video signal in the effective video period and potential of the video signal at the end time point of the transition period in the second frame period becomes equal to maximum potential of the video signal in the effective video period, and potential of a video signal to be applied to the plurality of video signal lines in the transition period is determined so that, when potential of the common electrode is set as low potential immediately after start of the transition period in the first frame period, potential of the video signal at the end time point of the transition period in the first frame period becomes equal to minimum potential of the video signal in the effective video period and potential of the video signal at the end time point of the transition period in the second frame period becomes equal to minimum potential of the video signal in the effective video period.

26. The driving method according to claim 25, wherein length of the transition period in the first frame period is set to be equal to length of the first number of horizontal scanning periods as an interval in which polarity of potential of the plurality of pixel electrodes with respect to potential of the common electrode is inverted, and length of the transition period in the second frame period is set to length which is twice as long as the length of the transition period in the first frame period.

* * * * *